US011357282B2

(12) United States Patent
Cohen et al.

(10) Patent No.: US 11,357,282 B2
(45) Date of Patent: Jun. 14, 2022

(54) SYSTEM AND METHOD FOR MEASURING AND CONTROLLING FOOT TEMPERATURE

(71) Applicants: Vivonics, Inc., Bedford, MA (US); University of North Texas Health Science Center, Fort Worth, TX (US)

(72) Inventors: Ian Cohen, Boulder, CO (US); Gordon B. Hirschman, Cohoes, NY (US); Anna M Galea, Stow, MA (US); Hsiang-Wei Ma, Allston, MA (US); Metin Yavuz, Grapevine, TX (US); Linda Adams, Flower Mound, TX (US); Ali Ersen, Fort Worth, TX (US)

(73) Assignees: Vivonics, Inc., Bedford, MA (US); University of North Texas Health Science Center, Fort Worth, TX (US)

( * ) Notice: Subject to any disclaimer, the term of this patent is extended or adjusted under 35 U.S.C. 154(b) by 0 days.

(21) Appl. No.: 16/205,399

(22) Filed: Nov. 30, 2018

(65) Prior Publication Data

US 2019/0159546 A1 May 30, 2019

Related U.S. Application Data

(60) Provisional application No. 62/592,733, filed on Nov. 30, 2017.

(51) Int. Cl.

| | |
|---|---|
| ***A43B 7/00*** | (2006.01) |
| ***A43B 7/02*** | (2022.01) |
| ***A43B 3/34*** | (2022.01) |

(52) U.S. Cl.

CPC ..... *A43B 7/005* (2013.01); *A43B 3/34* (2022.01); *A43B 7/02* (2013.01); *F25B 2321/0212* (2013.01); *F25B 2321/0251* (2013.01)

(58) Field of Classification Search

CPC ..... F25B 2321/0212; F25B 2321/0251; A43B 3/34; A43B 3/35

See application file for complete search history.

(56) References Cited

U.S. PATENT DOCUMENTS 3,906,185 A * 9/1975 Gross ..... A43B 3/0005 219/211
4,948,951 A * 8/1990 Balzano ..... A41D 19/01535 219/211

(Continued)

FOREIGN PATENT DOCUMENTS

WO WO 2017/062636 A1 4/2017

OTHER PUBLICATIONS

Written Opinion of the International Searching Authority dated Feb. 12, 2019 for International Application No. PCT/US2018/63235, eight (8) pages.

*Primary Examiner* — Jocelyn Bravo
(74) *Attorney, Agent, or Firm* — Iandiorio Teska & Coleman, LLP

(57) ABSTRACT

A system for measuring and controlling foot temperature. The system comprises a heating or cooling device including one or more sealed fluidic pathways having a cooling or heating fluid therein and disposed in or on an article of footwear or a sock. A pumping device coupled to the heating or cooling device is configured to circulate the fluid in the one or more sealed fluidic pathways. A heat exchanger coupled to the heating or cooling device is configured to remove or add heat from or to the fluid in the one or more sealed fluidic pathways. A controller coupled to the pumping device and the heat exchanger is configured to control the pumping device and the heat exchanger to cool or heat a foot located inside the article of footwear or the sock.

11 Claims, 18 Drawing Sheets

(56) References Cited

U.S. PATENT DOCUMENTS 4,995,173 A * 2/1991 Spier ..... A43B 5/0407 36/114
5,179,792 A * 1/1993 Brantingham ..... A43B 3/0005 251/4
5,375,345 A * 12/1994 Djuric ..... A43B 3/00 36/3 B
5,384,977 A * 1/1995 Chee ..... A43B 1/0009 36/28
5,637,389 A 6/1997 Colvin et al.
5,794,361 A * 8/1998 Sadler ..... A43B 13/206 36/29
5,953,835 A * 9/1999 Kwon ..... A43B 7/32 36/153
5,987,779 A * 11/1999 Litchfield ..... A43B 13/203 36/29
6,014,823 A * 1/2000 Lakic ..... A41D 19/01523 36/11.5
6,370,800 B1 * 4/2002 Hung ..... A43B 7/08 36/29
7,107,706 B1 * 9/2006 Bailey, Sr. ..... A43B 3/0005 36/29
7,204,041 B1 * 4/2007 Bailey, Sr. ..... A43B 3/0005 36/1
7,269,915 B2 * 9/2007 Flechsig ..... A43B 7/081 36/114
7,716,853 B2 * 5/2010 Finnegan ..... A43B 5/08 36/3 B
8,209,882 B2 * 7/2012 Leimer ..... A43B 7/081 36/3 R
8,857,076 B2 * 10/2014 Langvin ..... A43B 13/203 36/29
9,107,468 B1 * 8/2015 Xiong ..... A43B 7/02
9,215,905 B2 * 12/2015 Tseng ..... A43B 7/02
9,877,546 B2 * 1/2018 Rehkemper ..... A43B 23/24
2002/0050074 A1 * 5/2002 Ricco ..... A43B 7/02 36/3 R
2002/0066207 A1 * 6/2002 Cheng ..... A43B 7/081 36/3 R
2002/0069552 A1 * 6/2002 Ortiz ..... A43B 3/0005 36/3 R
2002/0189135 A1 * 12/2002 Hanks ..... A43B 1/0018 36/54
2003/0121174 A1 * 7/2003 Tsai ..... A43B 7/081 36/3 B
2004/0020076 A1 * 2/2004 Liu ..... A43B 1/0045 36/3 R
2004/0107600 A1 * 6/2004 Lin ..... A43B 13/12 36/3 B
2004/0118831 A1 * 6/2004 Martin ..... A43B 3/0005 219/494
2004/0159022 A1 * 8/2004 Winford ..... A43B 1/0027 36/136
2005/0060906 A1 * 3/2005 Zimerfeld ..... A43B 3/0005 36/3 R
2005/0258717 A1 * 11/2005 Mullen ..... A43B 3/0005 310/339
2006/0032082 A1 * 2/2006 Lin ..... A43B 7/081 36/3 B
2006/0058858 A1 * 3/2006 Smith ..... A01K 13/006 607/104
2007/0113564 A1 5/2007 Whitney et al.
2009/0084001 A1 * 4/2009 Sgattoni ..... A43B 7/081 36/3 A
2009/0199571 A1 * 8/2009 Creech ..... A61F 7/02 62/3.2
2010/0005687 A1 * 1/2010 Ramadoro (An) .. A43B 3/0005 36/3 B
2010/0170116 A1 * 7/2010 Shim ..... A43B 7/082 36/3 B
2012/0018418 A1 * 1/2012 Shantha ..... A43B 7/02 219/482
2012/0192452 A1 * 8/2012 Lewis ..... A43B 13/38 36/44
2012/0199222 A1 * 8/2012 Sullivan ..... A43B 1/0027 137/561 R
2013/0019503 A1 * 1/2013 Vogt ..... A43B 3/0005 36/103
2013/0019611 A1 * 1/2013 Sims ..... F25B 21/02 62/3.3
2013/0247410 A1 * 9/2013 Tseng ..... A43B 7/02 36/2.6
2013/0247424 A1 * 9/2013 Tseng ..... A43B 3/0005 36/136
2013/0285686 A1 * 10/2013 Malik ..... G01R 31/2875 324/750.05
2014/0013632 A1 * 1/2014 Mohlmann ..... A43B 7/081 36/25 R
2014/0182164 A1 * 7/2014 Krupenkin ..... A43B 7/02 36/2.6
2015/0088057 A1 * 3/2015 Su ..... A61M 5/20 604/66
2015/0196084 A1 * 7/2015 Litvinov ..... A43B 7/087 36/3 R
2015/0330855 A1 * 11/2015 Daniecki ..... A43B 3/0005 73/727
2016/0029740 A1 * 2/2016 Mohlmann ..... A43B 7/081 36/3 B
2016/0313174 A1 * 10/2016 Lightstone ..... G01G 19/50
2016/0346613 A1 * 12/2016 Schneider ..... H01L 35/02
2017/0105870 A1 * 4/2017 Yazdani ..... A61F 7/02
2018/0295930 A1 * 10/2018 Brienza ..... A43B 3/0005
2019/0159546 A1 * 5/2019 Cohen ..... A41B 11/00

* cited by examiner

SYSTEM AND METHOD FOR MEASURING AND CONTROLLING FOOT TEMPERATURE

RELATED APPLICATIONS

This application claims benefit of and priority to U.S. Provisional Application Ser. No. 62/592,733 filed Nov. 30, 2017, under 35 U.S.C. §§ 119, 120, 363, 365, and 37 C.F.R. § 1.55 and § 1.78, which is incorporated herein by this reference.

GOVERNMENT RIGHTS

This invention was made with government support under Contract Nos. R43DK109858 and UL1TR001105, both awarded by the National Institutes of Health. The government has certain rights in the invention.

FIELD OF THE INVENTION

This invention relates to a system and method for measuring and controlling foot temperature.

BACKGROUND OF THE INVENTION

Conventional therapeutic footwear has been shown to be marginally effective in preventing diabetic foot ulceration. This may be because conventional therapeutic footwear is typically designed to address only one causative factor, namely pressure. Diabetic foot ulceration has a complicated biomechanical pathology that involves not only plantar pressure but also shear stresses, physical activity, and the like. A number of pressure ulcer (i.e., bedsore) studies have shown that warmer tissue is more vulnerable to breakdown when compared to cooler tissue. A number of studies on human subjects have reported that individuals who developed pressure ulcers had significantly higher baseline skin temperatures. In one animal study, it was shown that tissue that was maintained at about 25° C. did not break down under 100 mmHg of static normal loading whereas tissue at about 35° C. experienced substantial damage. One or more of the inventors hereof have previously reported the association between plantar stresses and temperatures. The results indicated 1) resting plantar temperatures in diabetic foot are significantly higher, which are also moderately associated with plantar shear stress, and 2) plantar temperatures increase about 5.3° C. on average during about 10 minutes of barefoot walking, which is also associated with plantar shear. One or more of the inventors hereof also conducted a pilot study where it was observed that in a shoe, plantar temperatures may reach about 34° C. after 15 minutes of walking. It can be hypothesized that temperatures in diabetic feet would be higher given the higher plantar stresses in diabetic patients and their typically insulated footwear.

Therapeutic effects of hypothermia have also been studied extensively in ischemia related musculoskeletal injuries and pressure ulcers. It is known that local cooling leads to reduced pro-inflammatory agents and better blood circulation characteristics. Reducing metabolic activity through cooling has been shown to be effective in limiting the tissue damage after an injury.

SUMMARY OF THE INVENTION

In one aspect, a system for measuring and controlling foot temperature is featured. The system includes a heating or cooling device including one or more sealed fluidic pathways having a cooling or heating fluid therein and disposed in or on an article of footwear or a sock. A pumping device coupled to the heating or cooling device is configured to circulate the fluid in the one or more sealed fluidic pathways. A heat exchanger coupled to the heating or cooling device is configured to remove or add heat from or to the fluid in the one or more sealed fluidic pathways. A controller coupled to the pumping device and the heat exchanger is configured to control the pumping device and the heat exchanger to cool or heat a foot located inside the article of footwear or the sock.

In one embodiment, the one or more sealed fluidic pathways may be comprised of a thermally conductive material. The one or more sealed fluidic pathways may be configured in a loop. The one or more sealed fluidic pathways may be embedded or disposed in one or more of: an insole of the article of footwear, a side, a top, a front or a back of the article of footwear, a sole of the article of footwear, or a sock. The pumping device may be integrated in a sole of the article of footwear, attached to a side, a top, a front, or a back of the article of footwear, attached to a user, attached to an article attached to the user, or attached to a sock. The heat exchanger may be embedded or disposed in one or more of: an insole of the article of footwear, a side, a top, a front, or a back of the article of footwear, a sole of the article of footwear, or a sock. The heat exchanger may include a fluid block in fluid communication with the one or more sealed fluidic pathways. The system may include a heat sink coupled to the fluid block, a fan coupled to the heat sink, and a power supply coupled to the controller. The heat exchanger may include a thermoelectric cooling (TEC) device positioned between the fluid block and the heat sink and coupled to the controller and the power supply. The controller may be configured to control current or voltage applied to the TEC device such that the TEC device and the fluid block cools or heats the fluid in the one or more sealed fluidic pathways. The system may include one or more temperature sensors in communication with the controller and disposed or embedded in or on the one or more of: the sealed fluidic pathways, the fluid block, the heat sink, the TEC device, an insole of the article of footwear, a side, a top, a front, or a back of the article of footwear, a sole of the article of footwear, or a sock and configured to measure a temperature of one or more of: the fluid in the one or more sealed fluidic pathways, the fluid block, the heat sink, a hot side of the TEC device, a cold side of the TEC device, the insole of the article of footwear, a side, a top, a front, or a back of the article of footwear, a sole of the article of footwear, or a sock. The controller may be coupled to a proportional integral derivative (PID) control loop responsive to one or more measured input temperatures. The PID control loop may be configured to control a flow rate of the fluid output by the pumping device and the voltage and current applied to the TEC device to heat or cool the fluid in one or more sealed fluidic pathways. The system may include a temperature sensor layer including a plurality of temperature sensors placed under the foot and coupled to the controller, the temperature layer configured to measure a temperature of a bottom surface of a foot. The temperature layer may be integrated into an insole of the article of footwear, or a sole of the article of footwear, or a sock. The system may include a pressure sensor layer including a plurality of pressure sensors coupled to the controller, the pressure layer configured to measure pressure at a bottom of the foot. The system may include a phase change layer including a phase change material, the phase change layer placed under the foot and thermally coupled to the one or more sealed fluidic pathways. The phase change material may be configured to change phase in response to heat from the foot such that the phase change layer cools the foot. The system may include a stack of one or more of: a temperature sensor layer including a plurality of temperature sensors, a pressure layer including a plurality of pressure sensors, and a phase changer layer including a phase change material. The stack may be placed under the foot and configured to measure a temperature of a foot and/or a pressure of the foot and/or configured to cool the foot due to a phase change of the phase change material.

In another aspect, a system for measuring and controlling foot temperature is featured. The system includes one or more heat exchangers each including a thermoelectric cooling (TEC) device embedded into an article of footwear and in close proximity to a bottom of a foot. A cooling device is coupled to the TEC device and is configured to dissipate heat from the TEC device. A controller is coupled to the heat exchanger and is configured to control the TEC device to remove heat from a bottom of a foot to cool the foot or add heat to the bottom of the foot to heat the foot.

In one embodiment, the heat exchanger may be embedded into an insole of the article of footwear. The system may include a heat sink coupled to the TEC device and a power supply. The controller may be configured to control a current or voltage supplied to the TEC device by the power supply to provide a cooling temperature on a side of the TEC device in contact with the bottom surface of the foot to cool the foot or to provide a heating temperature on the side of the TEC device in contact with the bottom surface of the foot to heat the foot. The one or more heat exchangers may include a fan coupled to the heat sink and the controller may be configured to control the fan to dissipate heat from the heat sink. The fan may be disposed in a cut out area of the article of footwear. The controller may be configured to control the fan to circulate air into fins of the heat sink, out of the article of footwear, and into the environment. The system may include one or more temperature sensors in communication with the controller and disposed or embedded in or on one or more of: the heat sink, the TEC, an insole of the article of footwear, a side, a top, a front, or a back of the article of footwear, a sole of the article of footwear, or a sock and configured to measure the temperature of one or more of: the heat sink, the TEC device, the insole of the article of footwear, the side, the top, the front, or the back of the article of footwear, the sole of the article of footwear, or the sock. The insole may include a phase change material configured to change phase in response to heat from a foot such that the phase change material cools the foot.

In another aspect, a system for measuring and controlling foot temperature is featured. The system includes a bladder insole including a plurality sealed fluidic pathways having a cooling or heating fluid therein and disposed in an article of footwear. The bladder insole is configured to circulate the heating or cooling fluid through the sealed fluidic pathway in response to gate phases of a user while walking or running. A thermoelectric cooling device (TEC) is disposed in the bladder insole. The TEC device is configured to contact the heating or cooling fluid in the plurality of sealed fluidic pathways. A power supply is coupled to the TEC device. A controller is coupled to the TEC device and the power supply. The controller is configured to control the current or voltage applied by the power supply to the TEC device such that a side of the TEC device in contact with the heating or cooling fluid removes heat from fluid to cool the foot of a user or the side of the TEC device in contact with the heating or cooling fluid adds heat to the fluid to heat the foot of a user.

In one embodiment, the system may include a one-way check valve disposed in the sealed fluidic pathway configured to prevent backward flow of the fluid in the one or more sealed fluidic pathways. The sealed fluidic pathways may have a maze structure. The bladder insole may be comprised of a soft thermally conductive material. The soft thermally conductive material may have a predetermined thickness to provide thermal conductivity and comfort.

In another aspect, a method for measuring and controlling foot temperature is featured. The method includes providing one or more sealed fluidic pathways having a cooling or heating fluid therein and disposed in or on an article of footwear, circulating the fluid in the one or more sealed fluidic pathways, and controlling the circulating fluid and an amount of heat added or removed from the fluid in the one or more sealed fluidic pathways to cool or heat a foot.

In one embodiment, the one or more sealed fluidic pathways may be embedded or disposed in one or more of: an insole of the article of: an insole of the article of footwear, a side, a top, or a bottom of the article of footwear, or a sock. The method may include providing a thermoelectric cooling (TEC) device configured to cool or heat the fluid in the one or more sealed fluidic pathways. The method may include controlling a current or a voltage supplied to the TEC device such that a side of the TEC device in contact with the heating or cooling fluid removes heat from fluid to cool the foot or the side of the TEC device in contact with the heating or cooling fluid adds heat to the fluid to heat the foot. The method may include measuring the temperature of one or more of: the fluid in the one or more sealed fluidic pathways, an insole of the article of footwear, a side, a top, or a bottom of the article of footwear, the TEC device, or a sock.

In another aspect, a method for measuring and controlling foot temperature is featured. The method includes providing one or more heat exchangers each including a thermoelectric cooling (TEC) device embedded into an article of footwear and in close proximity to a bottom of a foot, dissipating heat from the TEC device, and controlling the TEC device to remove heat from a bottom of a foot to cool the foot or add heat to the bottom of the foot to heat the foot.

In one embodiment, the method may include controlling a current or a voltage supplied to the TEC device to provide a cooling temperature on a side of the TEC device in close proximity to the bottom surface of the foot to cool the foot or to provide a heating temperature on the side of the TEC device in in close proximity to the bottom surface of the foot to heat the foot. The method may include measuring the temperature of one or more of an insole of an article of footwear, a top, a side or a bottom of the article of footwear, a side of the article of footwear, the TEC device, a heat sink, or a sock.

The subject invention, however, in other embodiments, need not achieve all these objectives and the claims hereof should not be limited to structures or methods capable of achieving these objectives.

DETAILED DESCRIPTION OF THE INVENTION

Figure 1:
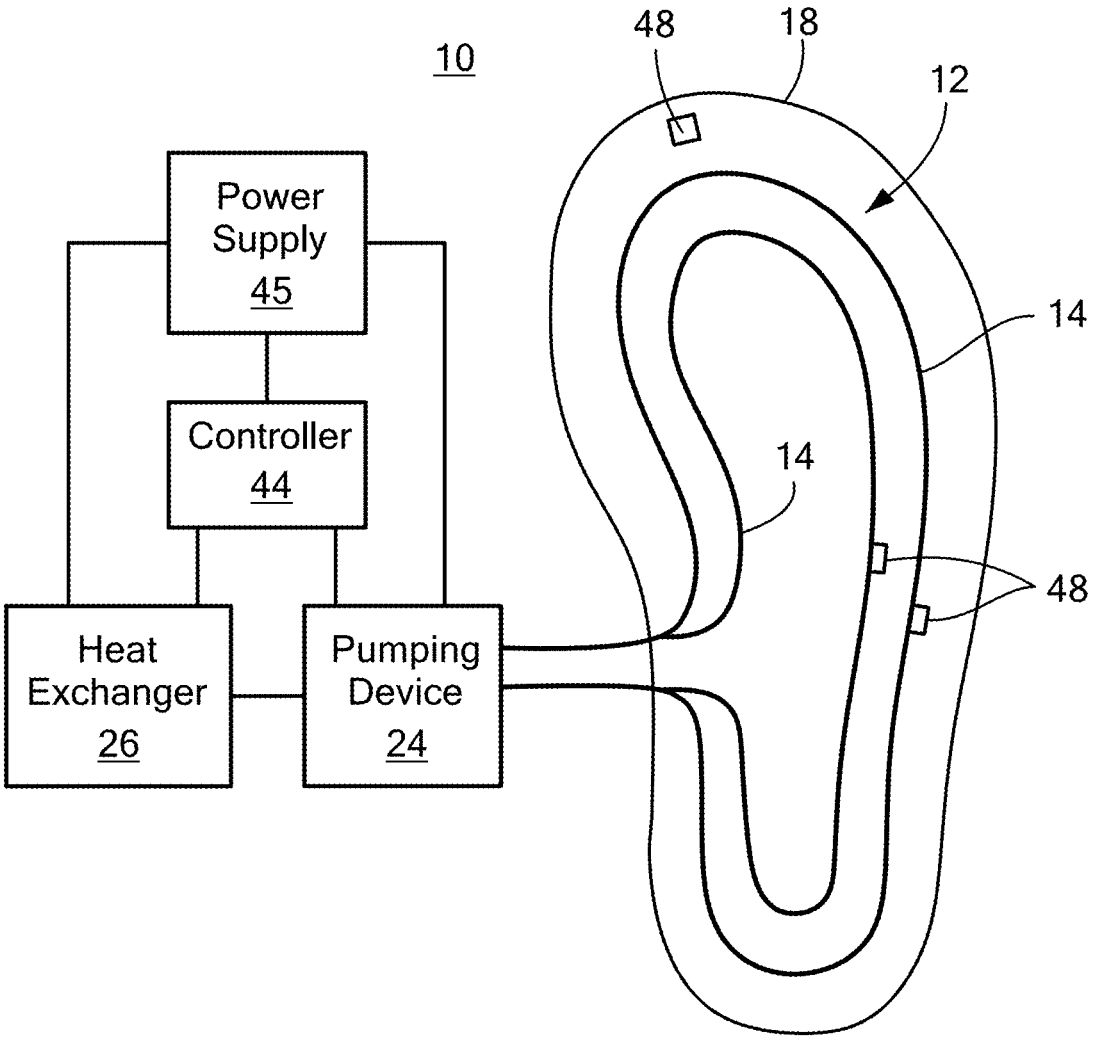
FIG. 1 is a schematic showing the primary components of the system and method for measuring and controlling foot temperature.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings.

Figure 2:
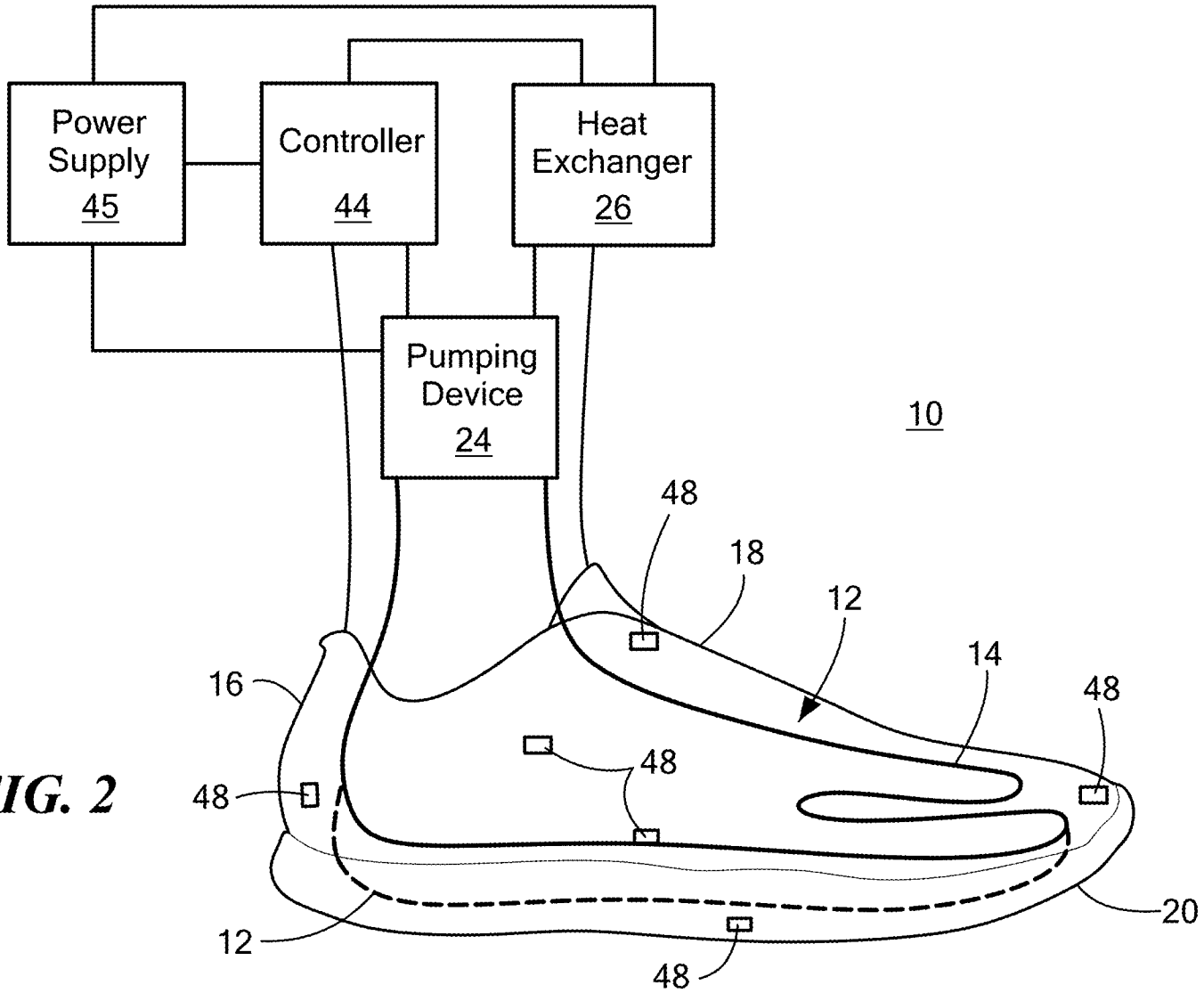
FIG. 2 is a schematic showing the primary components of the system and method for measuring and controlling foot temperature.
Figure 3:
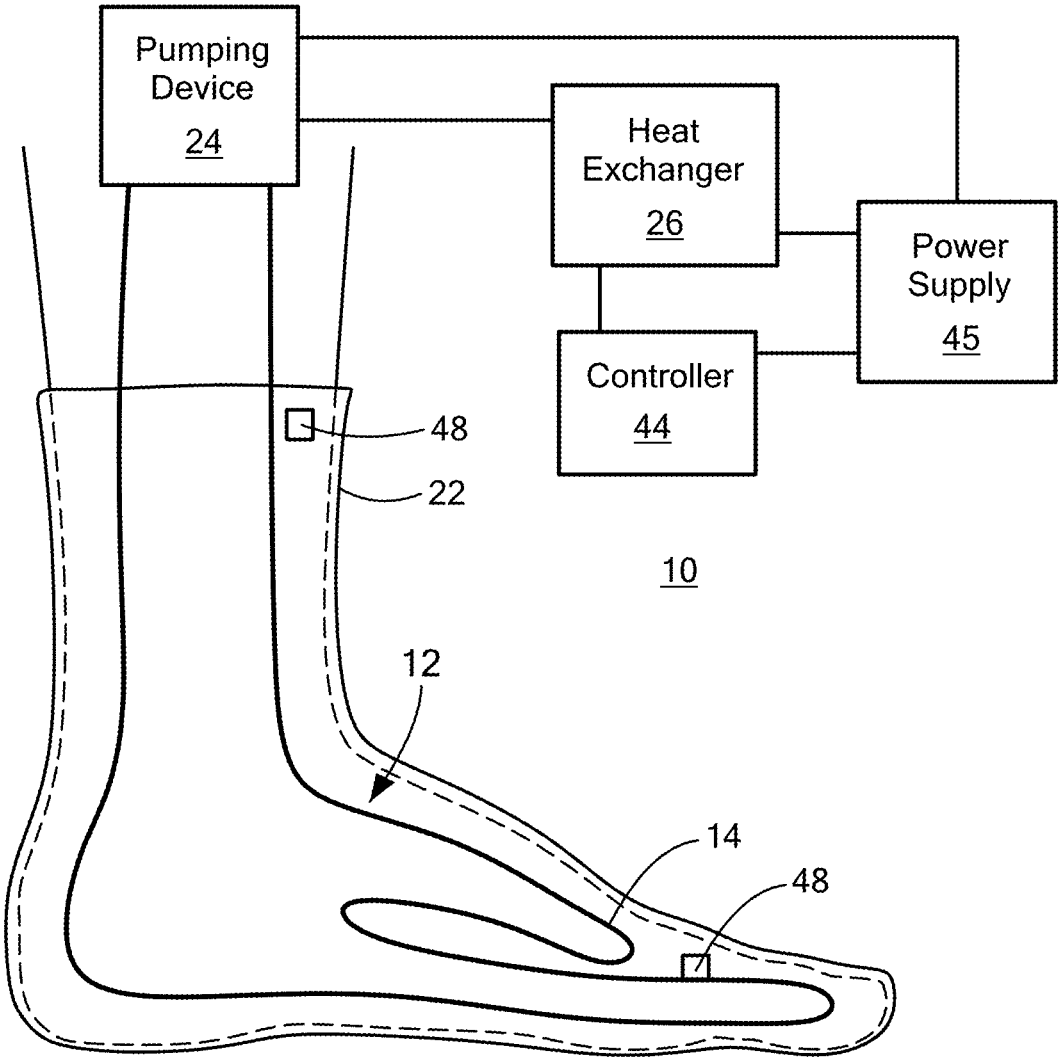
FIG. 3 is a schematic showing the primary components of the system and method for measuring and controlling foot temperature.

There is shown in FIGS. 1-3 one embodiment of system 10 and the method thereof for measuring and controlling foot temperature of this invention. System 10 includes heating or cooling device 12 including one or more sealed fluidic pathways 14 having a heating or cooling fluid therein and embedded in or on article of footwear 16, FIG. 3, in this example a shoe. In other designs, article of footwear 16 may be a sneaker, boot, or similar type article of footwear. In one example, one or more sealed fluidic pathways 14 may be configured in a loop, e.g., as shown in FIGS. 1-3. In one design, one or more sealed fluidic pathways 14 are preferably comprised of tubing as shown, e.g., about 1/16 to about 1/4 inches in diameter. The walls of the tubing are preferably between about 1/64 and about 1/16 inches thick. In other examples, the diameter and thickness of the walls may be greater or less than the example above. The tubing of one or more sealed fluidic pathways 14 is preferably comprised a thermally conductive material, e.g., plastic or similar type material, metal, e.g., copper or similar type metal, or a combination of plastic and metal. One or more sealed fluidic pathways 14 may be configured as a single looped tube or several tubes connected at one or more intersections which may reduce the resistance to flow within the tubing.

In one design, one or more sealed fluidic pathways 14 may be embedded into a cooling layer that is located underneath the foot, as discussed below. The cooling layer may be integrated into insole 18, FIG. 1, sole 20, FIG. 2, or sock 22, FIG. 3. In one design, one or more sealed fluidic pathways 14 may be surrounded by a thermally conductive material within the cooling layer to facilitate uniform distribution of the cooling.

System 10, FIGS. 1-3 also include pumping device 24 coupled to the heating or cooling device 12, pumping device 24, circulates the heating or cooling fluid in the one or more sealed fluidic pathway 14. In one example the heating or cooling fluid may be water, antifreeze, or similar type heating or cooling fluid. Pumping device 24 may be a manual pump, e.g., a hand pump, a foot pump, an electronic pump, e.g., a diaphragm pump, a centrifugal pump, a mini peristaltic pump, a bladder system activated by foot pressure, or similar type pumping device. Pumping device 24 may be integrated into sole 20, FIG. 2, attached to the top, sides, front or back of article of footwear 16, attached to the ankle, e.g., attached to sock 22, FIG. 3, or strapped to ankle, or attached to an article attached to a user, e.g., clipped onto pants, strapped to the thigh, or strapped to the calf, attached to the waist, e.g., with a belt clip, a hip pack, and the like, or attached to the back, e.g., with a backpack, fanny pack, or similar type device, as discussed below.

System 10, FIGS. 1-3, and method thereof preferably includes a heat exchanger 26 coupled to the heating or cooling device 12. Heat exchanger 26 removes or adds heat from or to the fluid in the one or more sealed fluidic pathways 14. In one design, heat exchanger 26 may be embedded or disposed in one or more of insole 18, FIG. 1, sole 20, FIG. 2, attached to the top, sides, back or front of article of footwear 16, attached to the ankle, attached to sock 22, FIG. 3, strapped to ankle, clipped onto pants, strapped to the thigh, or strapped to the calf, attached to the waist, e.g., with a belt clip, a hip pack, and the like, or attached to the back, e.g., with a backpack, fanny pack, or similar type device, as discussed below.

Figure 4:
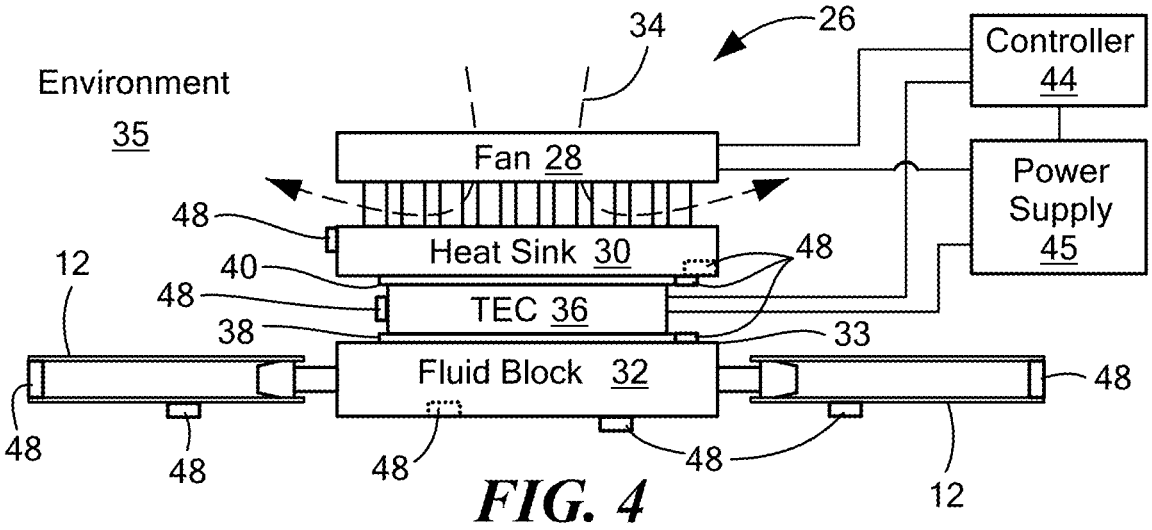
FIG. 4 is a schematic view showing in further detail one example of the heat exchanger shown in FIGS. 1-3.
Figure 5B:
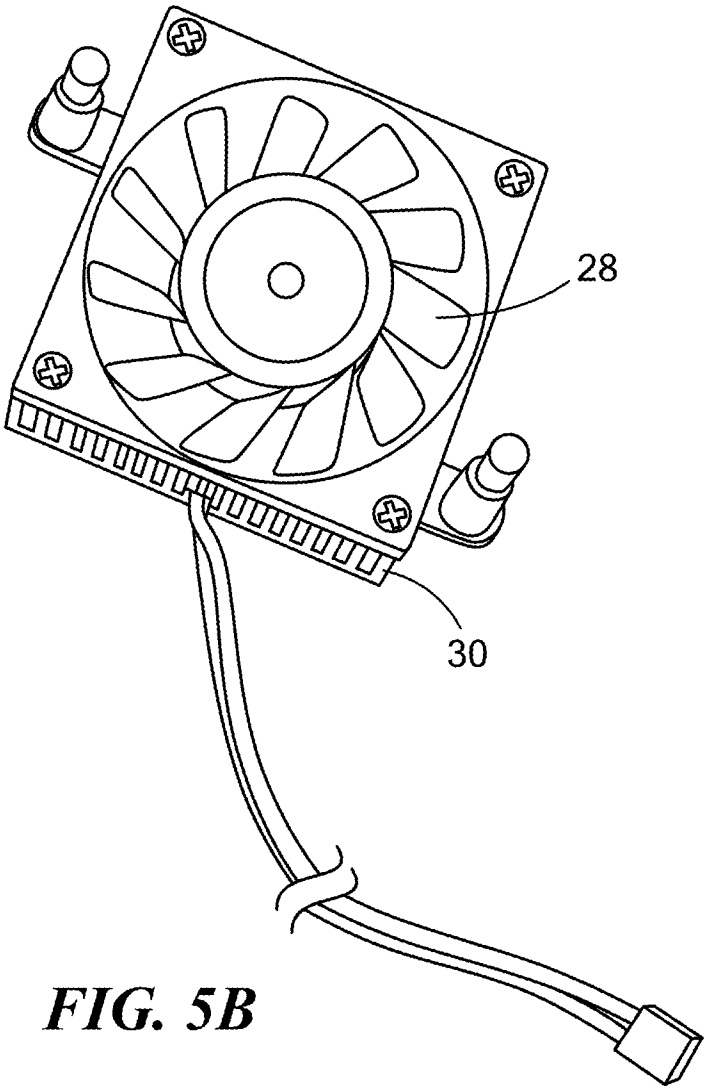
FIGS. 5A and 5B are three-dimensional views showing examples of the fan and heat sink which may be utilized by heat exchanger shown in one or more of FIGS. 1-4.
Figure 5A:
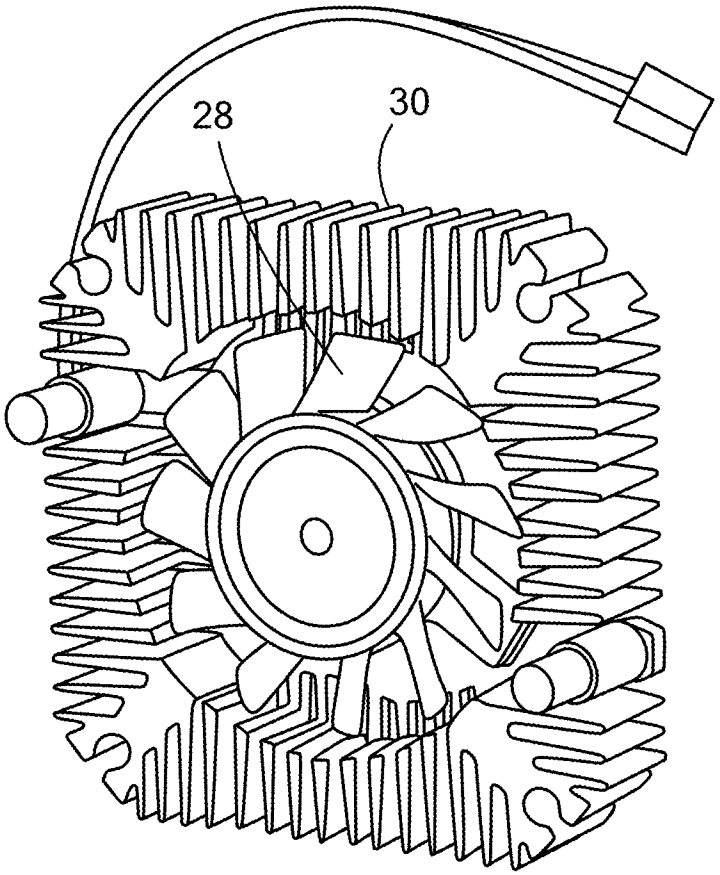

In one design, heat exchanger 26, FIGS. 1-3, shown in greater detail in FIG. 4, preferably includes fan 28, FIG. 4, heat sink 30, and fluid block 32. In this example, fluid from one or more sealed fluidic pathways 14, FIGS. 1-4, is driven by pumping device 24 through the fluid block 32, FIG. 4. Fluid block 32 preferably includes a high surface area of metal which contacts the fluid in one or more sealed fluidic pathways 14, e.g., channels, pins, fins, and the like. Heat is removed from top surface 33 of fluid block 32 which in turn draws heat from the liquid flowing through fluid block 32 from one or more sealed fluidic pathways 14. In operation, when fan 28 blows air 34 over heat sink 30, heat is drawn from heat sink 30, fluid block 32, and the circulating fluid in one or more sealed fluidic pathways 14 which is vented into surrounding environment 35 to effectively cool the foot of a user located in article of footwear 16 or sock 18. In one deign, fan 28 may be embedded into the heat sink 30 as shown in FIG. 5A to form a single unit as shown or fan 28 may be coupled to heat sink 30 as shown in FIG. 5B.

System 10, FIGS. 1-4, also includes a controller 44 coupled to pumping device 24 and heat exchanger 26 configured to control pumping device 24 and heat exchanger 26 to cool or heat a foot located inside the article of footwear 16 or sock 22, as discussed in further detail below. System 10 also includes power supply 45, e.g., a battery pack or similar type power supply, coupled to heat exchanger 26 and pumping device 24.

Controller 44 may be a processor, one or more processors, an application-specific integrated circuit (ASIC), firmware, hardware, and/or software (including firmware, resident software, micro-code, and the like) or a combination of both hardware and software that may all generally be referred to herein as a "controller", which may be part of the system and method for measuring and controlling foot temperature and of this invention Computer program code for the programs for carrying out the instructions or operation of one or more embodiments of the system and method for measuring and controlling foot temperature and controller 44 of this invention may be written in any combination of one or more programming languages, including an object oriented programming language, e.g., C++, Smalltalk, Java, and the like, or conventional procedural programming languages, such as the "C" programming language or similar programming languages.

In one example, heat exchanger 26, shown in one or more of FIGS. 1-5B, preferably includes thermoelectric cooling (TEC) device 36, FIG. 4, e.g., a heat pump, such as a Peltier thermoelectric heat pump, or similar type TEC device. In this example, TEC device 36 is positioned between fluid block 32 and heat sink 30 as shown. When a current or voltage is applied to TEC device 36, TEC device 36 pumps heat from the cold side 38 to the hot side 40. TEC device 36 is preferably positioned so that cold side 38 is in thermal contact with fluid block 32 and hot side 40 is in thermal contact with heat sink 30. In other designs, TEC device 36 may be used to heat the fluid in one or more sealed fluidic pathways 14 by changing the direction of current or voltage applied (via a change in polarity of applied voltage by power supply 45) to TEC device 36, e.g., when article of footwear 16 needs to be heated in cold climate conditions.

System 10 may include one or more temperature sensors 48, FIGS. 1-4, disposed or embedded in or on the one or more of one or more sealed fluidic pathways 14, fluid block 32, the heat sink 30, TEC device 36, insole 18 of the article of footwear 16, a side, a top, a front, or a back of the article of footwear 16, sole 20 of article of footwear 16, or sock 22. One or more temperature sensors 48 are configured to measure a temperature of one or more of the fluid in the one or more sealed fluidic pathways 14, fluid block 32, the heat sink 30, TEC device 36, insole 18 of the article of footwear 16, a side, a top, a front, or a back of the article of footwear 16, sole 20 of article of footwear 16, or sock 22.

Figure 6:
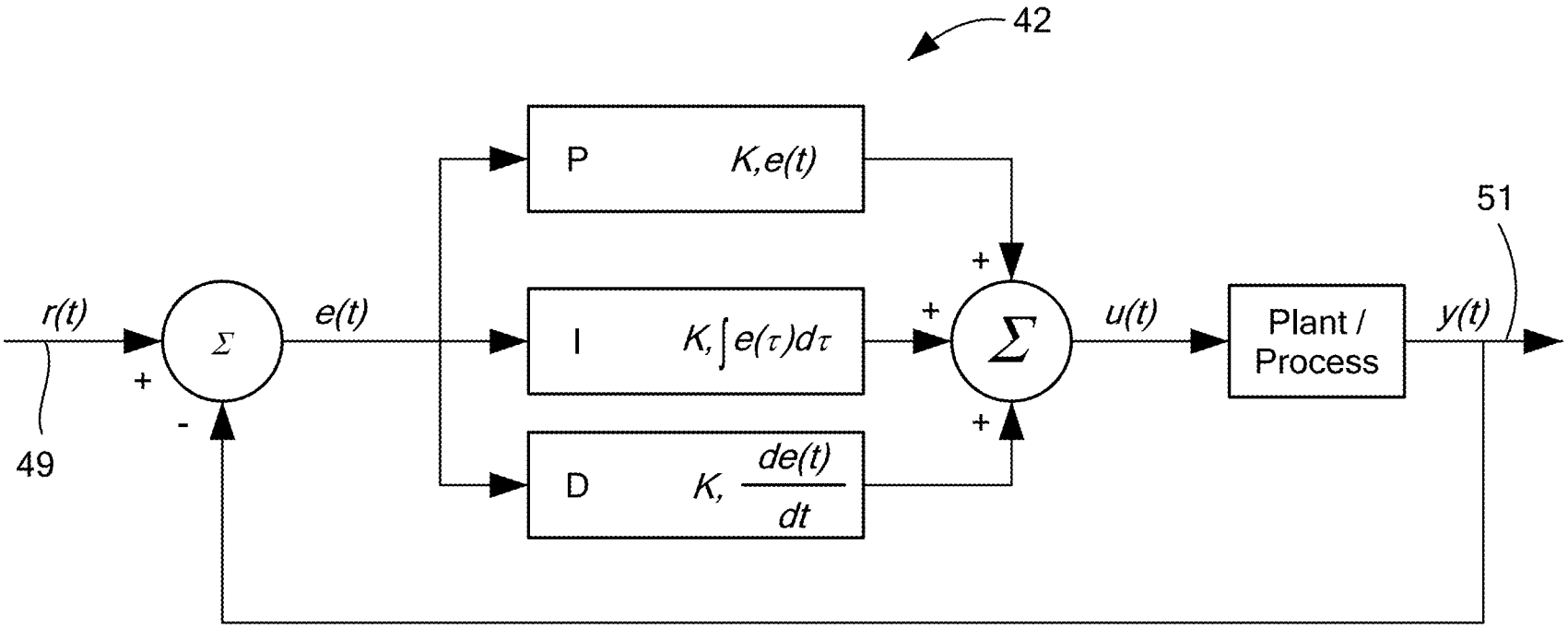
FIG. 6 is a schematic block diagram showing an example of a proportional integral derivative central loop which may be utilized by the controller shown in FIGS. 1-5.

In one design, system 10 may include proportional integral device (PID) control loop 42, FIG. 6, coupled to controller 44, FIGS. 1-4. PID control loop 42, FIG. 6, is responsive to one or more measured input temperatures measured by one or more temperature sensors 48 at input 49, FIG. 6, and controls the flow rate of fluid output by pumping device 24, FIGS. 1-4 and the voltage or current applied to TEC device 36. As discussed above, in one example, the voltage or current applied to TEC device 36 heats or cools fluid block 32, FIG. 4, which heats or cools the fluid in one or more sealed fluidic pathways 14.

Figure 7:
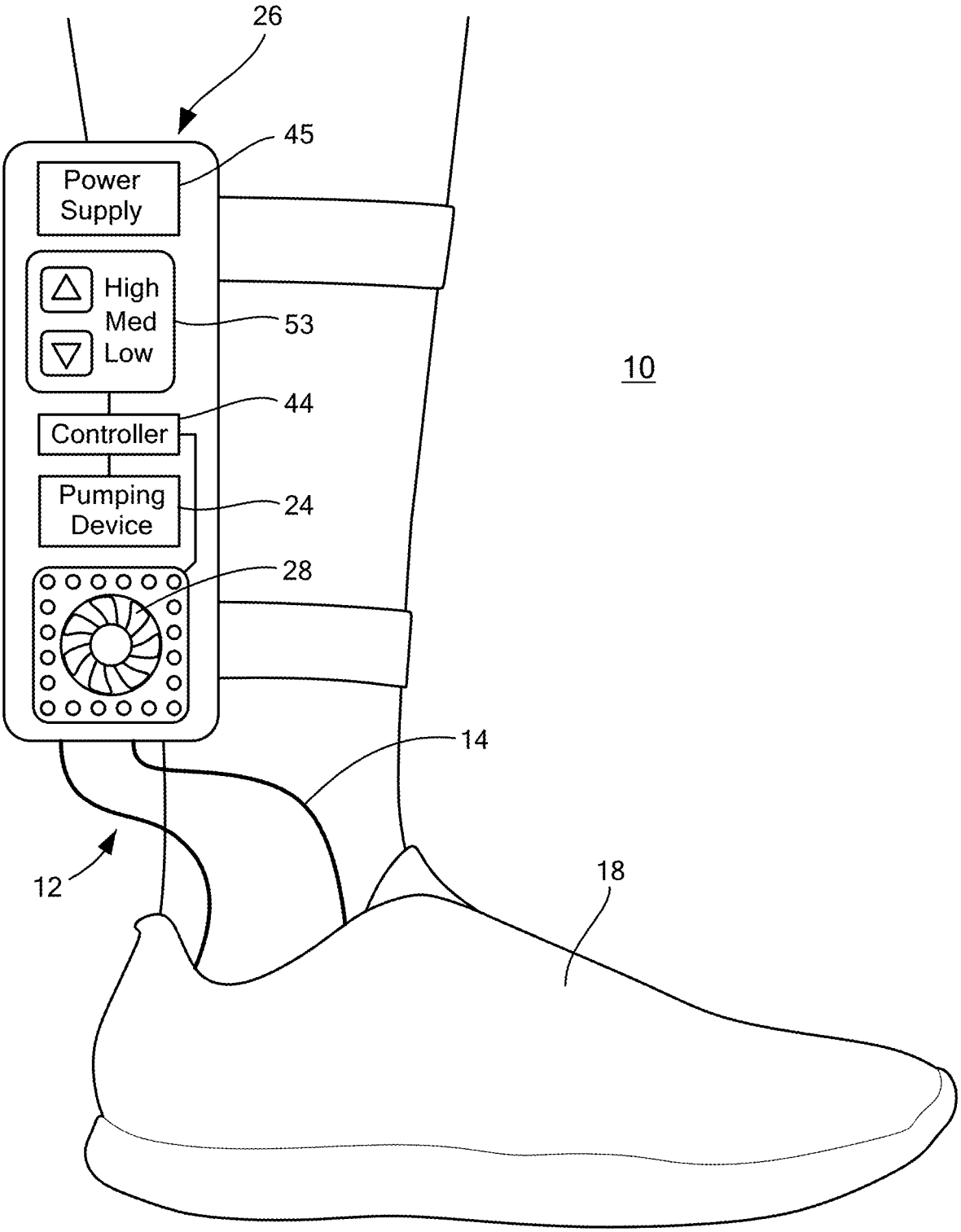
FIG. 7 is a schematic view showing one example of the system shown in one or more of FIGS. 1-6 attached to a leg of a human subject.

System 10 may also include control buttons 53, FIG. 7, coupled to controller 44 which are configured to receive user input.

Figure 8:
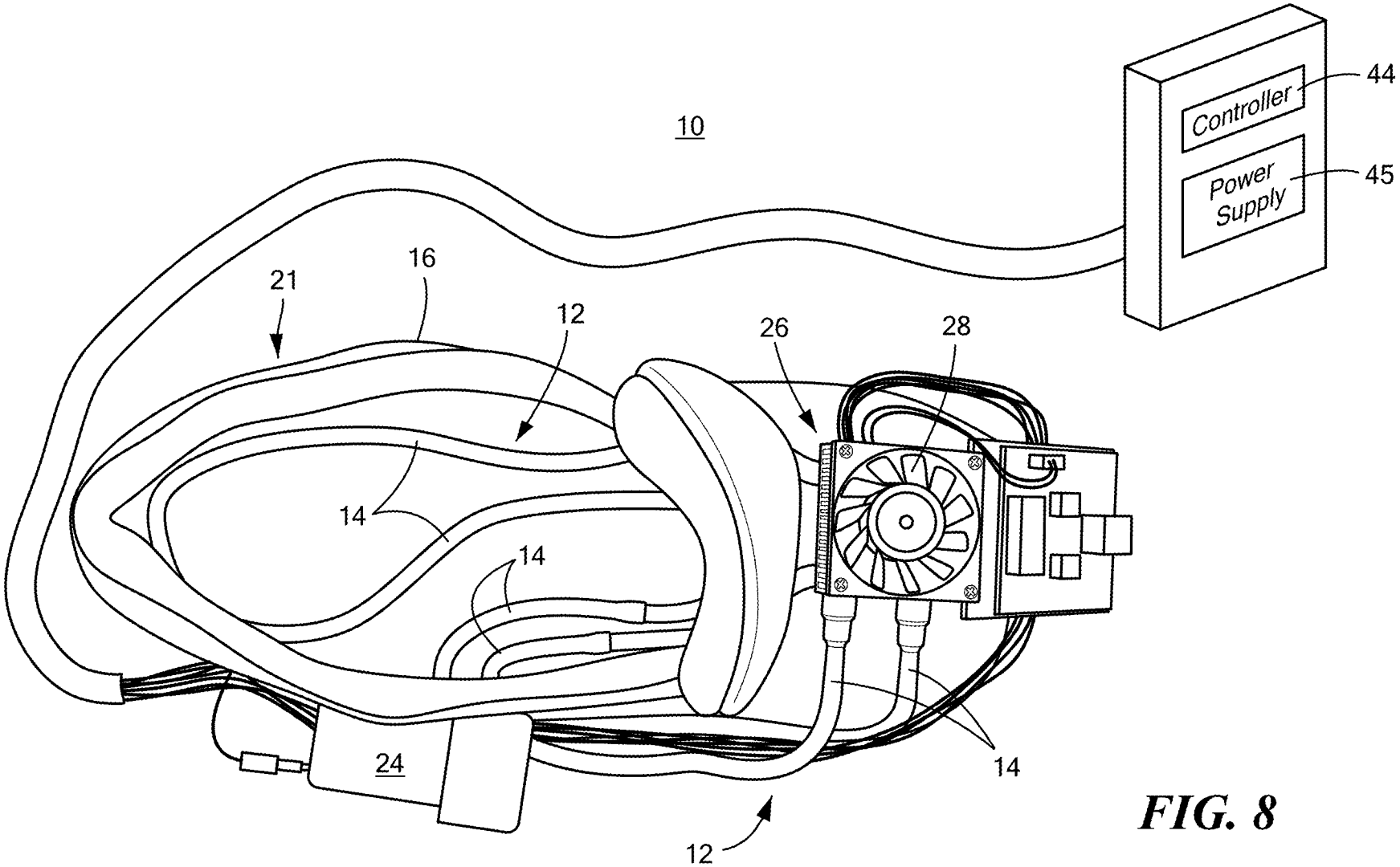
FIG. 8 is a three-dimensional top-view showing one example of a prototype of the system shown in one or more of FIGS. 1-7.
Figure 9:
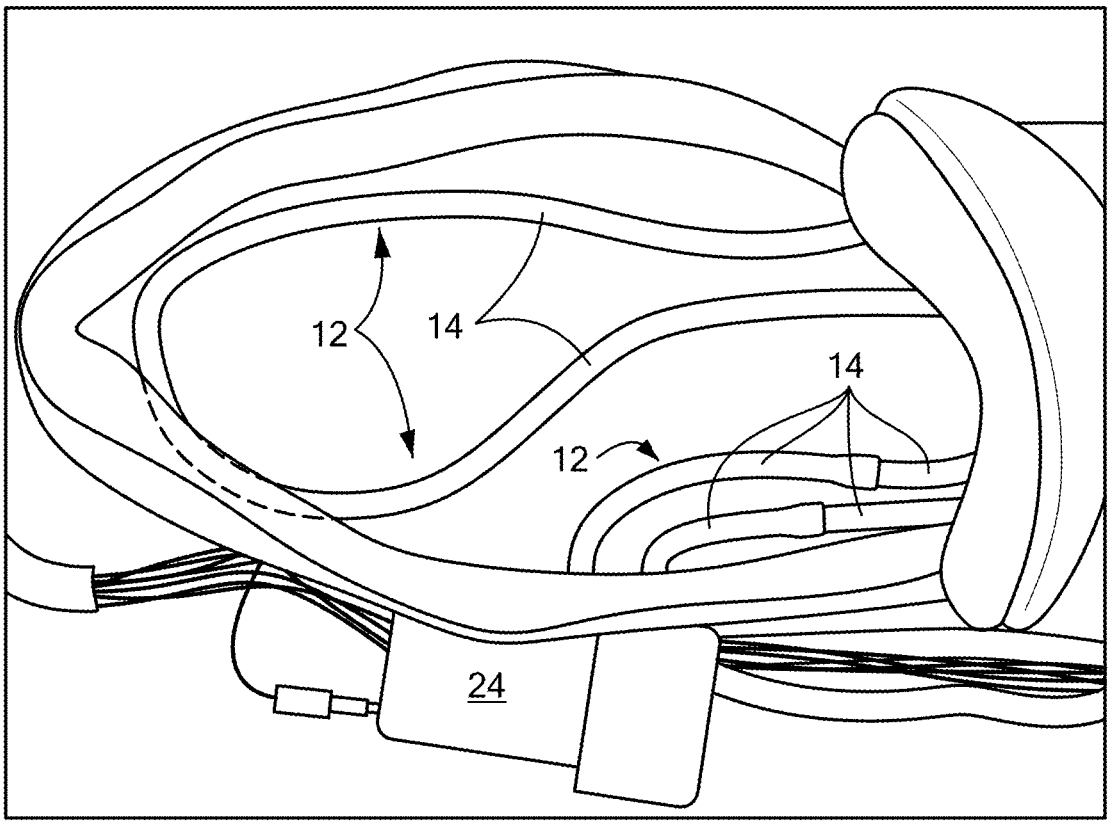
FIG. 9 is a three-dimensional top-view showing in further detail the prototype of the system shown FIG. 8.
Figure 10:
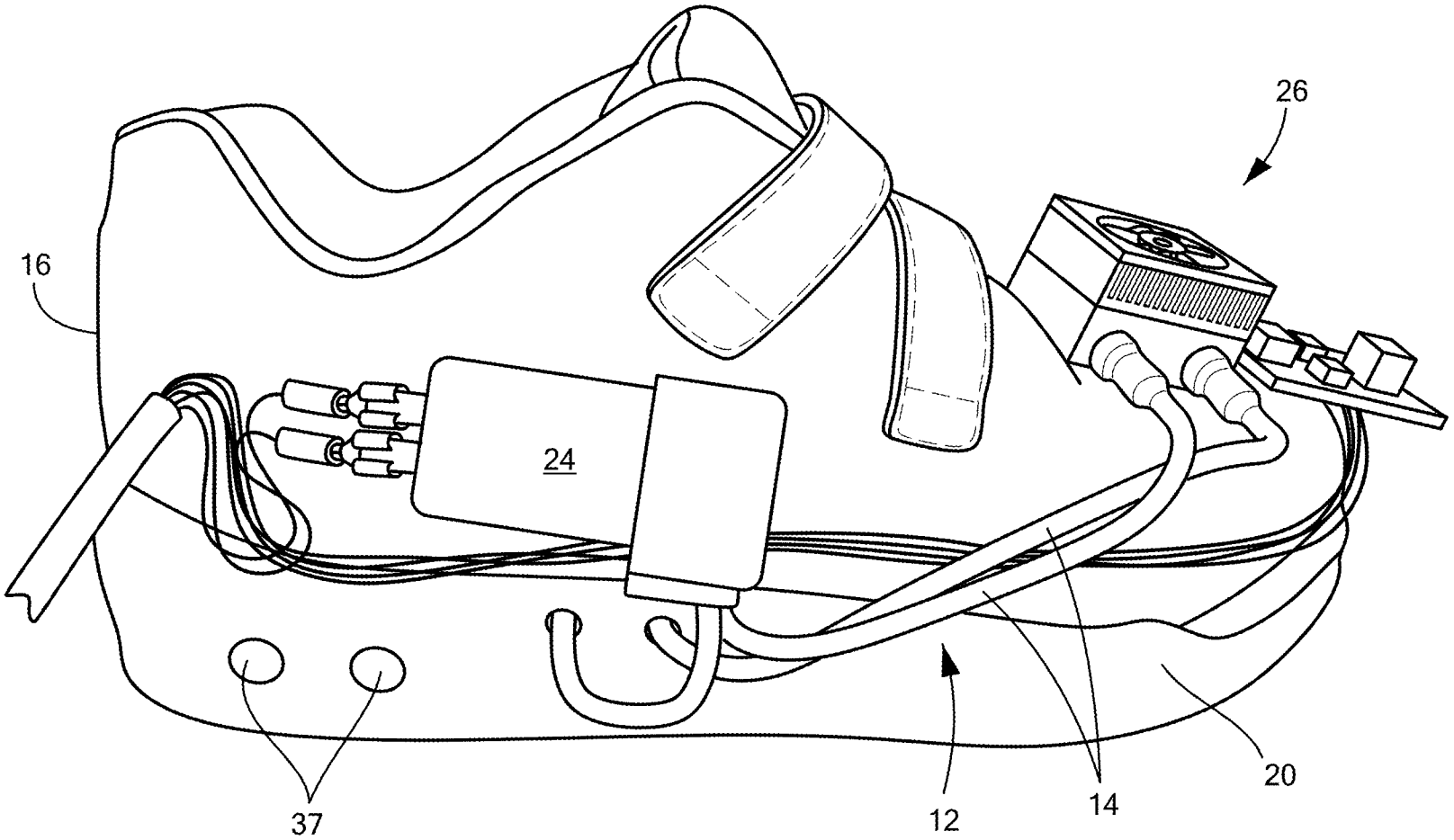
FIG. 10 is a three-dimensional side-view showing in further detail the prototype of the system shown FIGS. 8 and 9.

FIGS. 8, 9, and 10, where like parts have been given like numbers, show an example of a prototype of system 10 and the method thereof shown in one or more of FIGS. 1-7. In this example, heat exchanger 26, FIGS. 8 and 10, is located on top of the toe box of article of footwear 16 as shown and pumping device 24 is preferably a mini peristaltic pump located on the side of article of footwear 16 as shown and is coupled to one or more sealed fluidic pathways 14, as shown in further detail in FIG. 10. In this example, the cooling or heating fluid is circulated by pumping device 24 through one or more sealed fluidic pathways 14 made of cooper tubing inside article of footwear 16 and plastic tubing on the outside of article of footwear 16 as shown. In one example, to mitigate possible comfort issues and ulcer risk that may result from using one or more sealed fluidic pathways 14 made of a metal such as copper or similar type material, a thick insole may be placed on top of the copper fluid loops 12. In this design, power supply 45, FIG. 8, e.g., a battery pack or similar type power supply and controller 44 are preferably attached to the calf, e.g., as discussed above with reference to FIG. 7. In other designs, heat exchanger 26 may be located inside the area of the heel cup of article of footwear 16 e.g., as indicated at 21, FIG. 8. In one design, holes 37, FIG. 10 may be cut into sole 20 to further dissipate heat from the TEC device 36 of heat exchanger 26 discussed above with reference to FIG. 4 and copper fluid loops 12.

Figure 12:
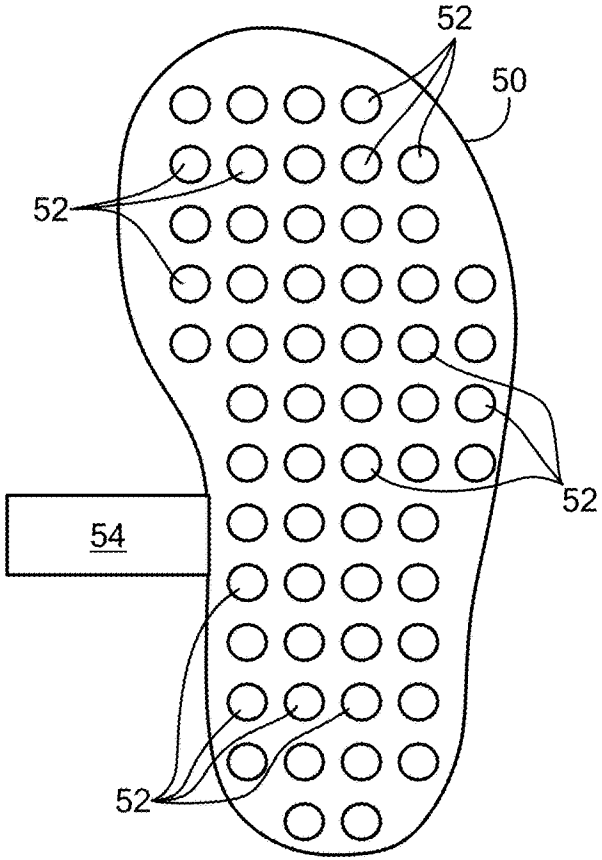
FIG. 12 is a schematic view showing an example of a layer of a plurality of temperature sensors disposed in a grid pattern on an insole of article of footwear in accordance with one embodiment of the system and method for measuring and controlling foot temperature.
Figure 11:
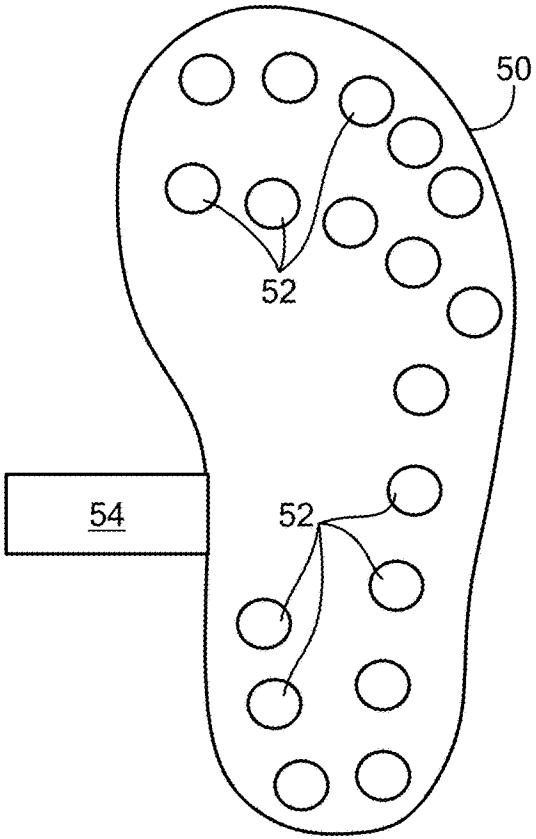
FIG. 11 is a schematic view showing an example of a layer of a plurality of temperature sensors disposed at predetermined locations on an insole of article of footwear in accordance with one embodiment of the system and method for measuring and controlling foot temperature.

System 10 and method thereof for measuring and controlling foot temperature shown in one or more of FIGS. 1-10 of this invention may include temperature sensor layer 50, FIGS. 11 and 12, located under the foot, configured to measure the temperature of the foot. Temperature sensor layer 50 may be integrated in insole 18, FIG. 2, sole 20, FIG. 2, or sock 33, FIG. 3. Temperature sensor layer 50, FIGS. 11-12 preferably includes a plurality of temperature sensors exemplarily indicated at 52 which are preferably coupled to controller 44, shown in one or more of FIGS. 1-10, by connector 54, FIGS. 11-12. Temperature sensors 52 may be a thermocouple, a thermistor, a thin-film type sensor, or similar type temperature sensor, or a combination thereof. Temperature sensors 52 may be disposed at key locations in temperature layer 50, such as the ball of the foot, big toe, or heel as shown in FIG. 11 or disposed in a grid pattern in temperature layer 50 as shown in FIG. 12. The temperature measurements from temperature sensors 50 may be used by controller 44 and/or as the input to PID control loop 42, FIG. 6.

Figure 13:
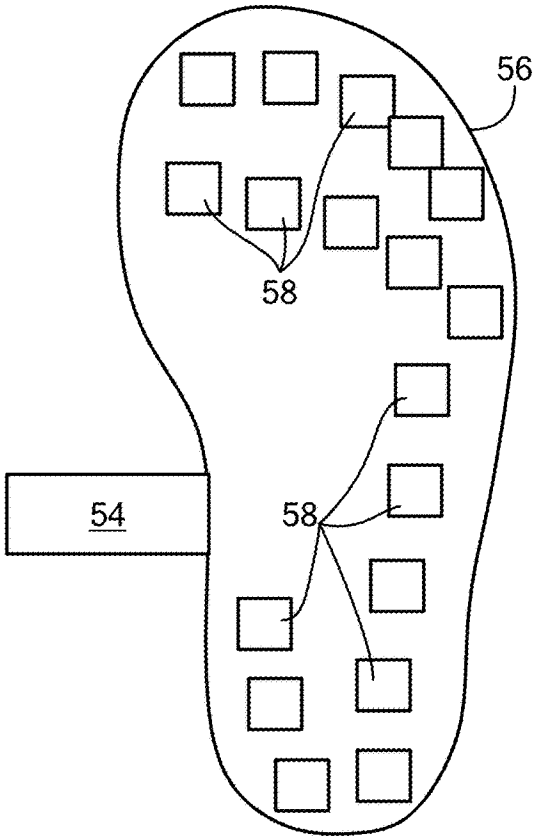
FIG. 13 is a schematic view showing an example of a layer of a plurality of pressure sensors disposed at predetermined locations on an insole of article of footwear in accordance with one embodiment of the system and method for measuring and controlling foot temperature.
Figure 14:
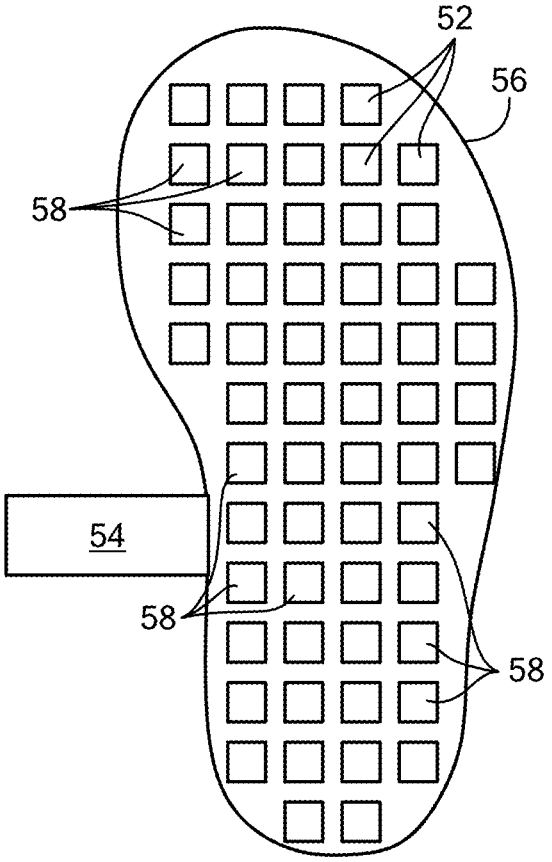
FIG. 14 is a schematic view showing an example of a layer of a plurality of pressure sensors disposed in a grid pattern on an insole of article of footwear in accordance with one embodiment of the system and method for measuring and controlling foot temperature.

System 10 and method thereof for measuring and controlling foot temperature of this invention shown in one or more of FIGS. 1-10 may include pressure layer 56, FIGS. 13 and 14 configured to measure pressure at the bottom of the foot. Pressure layer 56 may be incorporated into the temperature sensing layer 50, FIGS. 11-12, or it may be a separate layer incorporated into an insole 14, FIG. 1, sole 18, FIG. 2, or sock 18, FIG. 3. Pressure layer 56, FIGS. 13-14, preferably includes pressure sensors exemplarily indicated at 58, e.g., thin-film sensors, such as printed ink pressure sensors, fabric pressure sensors, or similar type pressure sensor preferably coupled to controller 44, as shown in one or more of FIGS. 1-10, by connector 54. Pressure sensors 58 may be disposed at key locations in pressure layer 56, such as the ball of the foot, big toe, or heel, as shown in FIG. 13, or disposed in grid pattern in pressure layer 56 as shown in FIG. 14. These pressure measurements from pressure sensors 56 may be used as the input to PID control loop 42, FIG. 6 and controller 44, shown in one or more of FIGS. 1-10.

Figure 15:
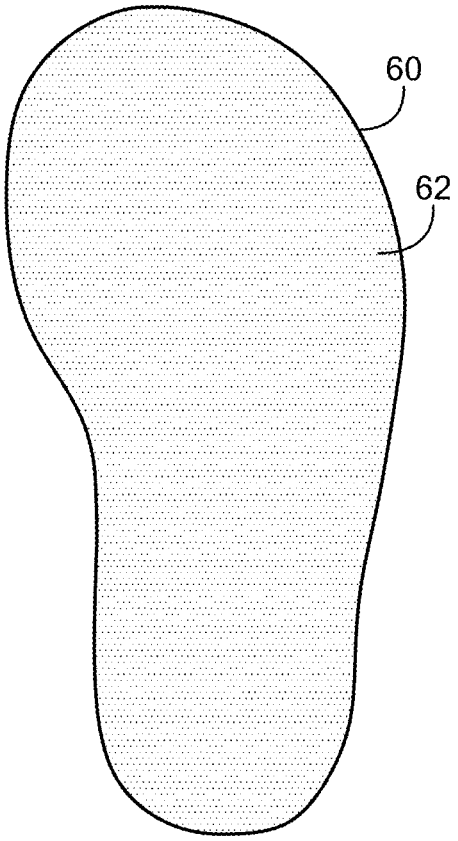
FIG. 15 is a schematic view showing an example of an insole made of a phase change material in accordance with one embodiment of the system and method for measuring and controlling foot temperature.

System 10 and method thereof for measuring and controlling foot temperature of this invention may include phase change layer 60, FIG. 15, comprised of phase change material 62. Phase change layer 60 is preferably placed under the foot and is thermally coupled to the one or more sealed fluidic pathways 14, FIGS. 1-4. The phase change material is preferably configured to change phase in response to heat from the foot such that the phase change layer cools the foot. Phase change material 60 preferably has a transition temperature selected to match the desired temperature to which the foot is to be cooled. When the foot exceeds this temperature, heat from the foot causes phase change material 62 to change phase but maintain constant temperature until all of phase material 62 had changed phase. Thus, phase change material 62 provides a consistent surface temperature and acts to smooth temperature variations at the foot surface. If phase change layer 60 with phase change material 60 is used by itself, it may only provide cooling for a limited period of time, e.g., the time it takes for heat removed from the foot to cause all the material to transition phase. However, when phase change material 62 of phase layer 60 is coupled with an active cooling system, e.g., as discussed above with reference to one or more of FIGS. 1-10, heat is continuously removed from phase change material 62, preventing it from reaching the point where all the material has changed phase to allow controlled temperature operation for extended periods of time. Phase change material 62 may be paraffin wax, microencapsulated paraffin wax, salt hydrates, polyethylene glycol, or similar type phase change material. Phase change layer 60 may be incorporated inside in insole 18, FIG. 1, sole 20, FIGS. 2 and 10, or in or on sock 22, FIG. 3. Phase change layer 60 may be its own layer or may be stacked with the cooling layer, temperature sensing layer, and pressure sensing layer.

Figure 16:
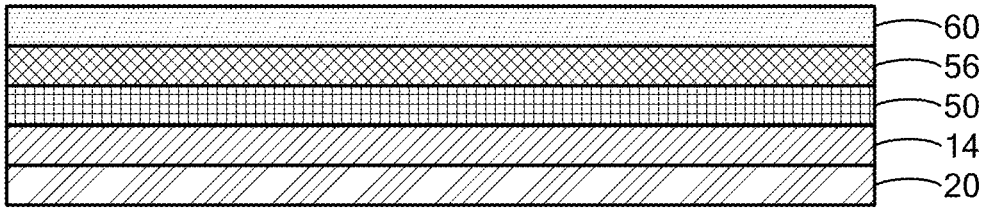
FIG. 16 is a schematic view showing an example of a stack of an insole, a fluid cooling layer, a pressure sensing layer, and a phase-change layer in accordance with one embodiment of the system and method for measuring and controlling foot temperature.

In one example, the cooling layer, e.g., one or more sealed fluidic pathways 14, temperature sensing layer 50, pressure sensing layer 56 and phase change layer 60 may be stacked to form a sole or insole capable of measuring pressure and temperature, and applying cooling based on the measurements obtained therefrom. There many possible configurations for stacking the layers. In one example, the fluid cooling layer comprised of one or more sealed fluidic pathways 14 is stacked on top of sole 20, FIG. 16, temperature sensing layer 50 is stacked on top of fluid cooling layer 12, pressure sensing layer 56 is stacked on top of temperature sensing layer 50 and phase change layer 60 is stacked at the top located closest to the foot. In other examples, the cooling layer, temperature sensing layer pressure sensing layer and phase change layer may be stacked in any desired arrangement.

Figure 17:
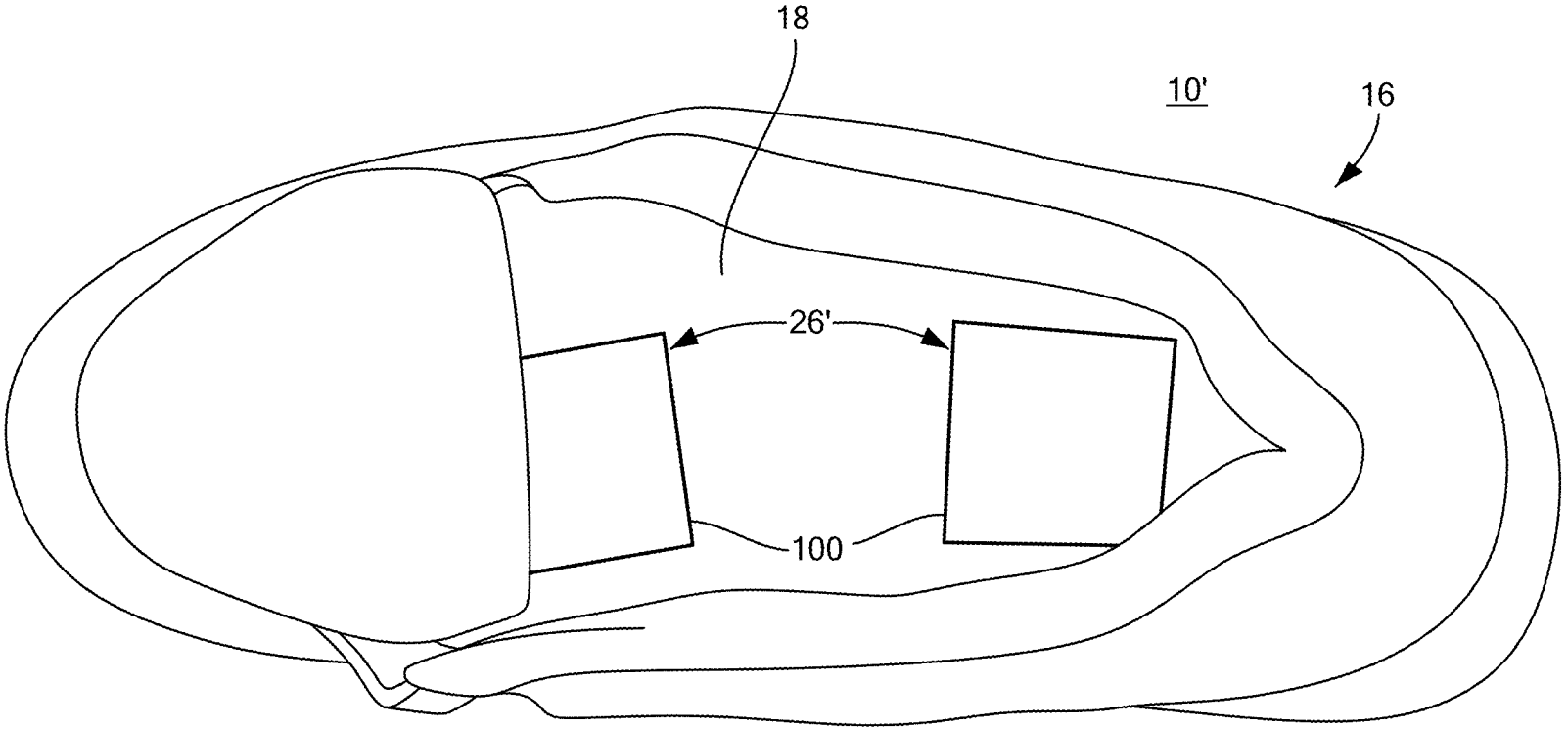
FIG. 17 is a three-dimensional top-view of another example of the system and method for controlling foot temperature.
Figure 18:
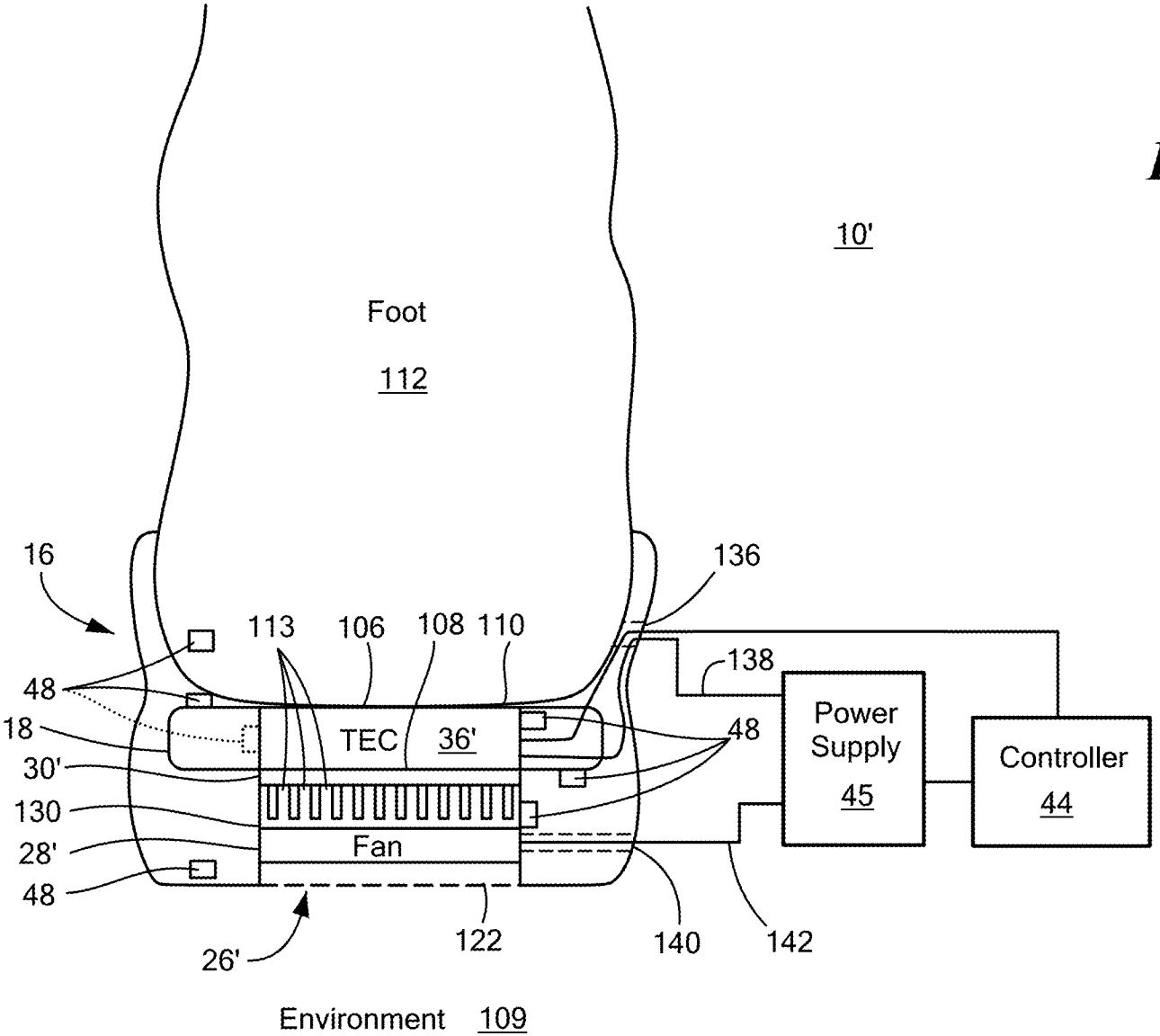
FIG. 18 is a schematic end-view showing in further detail the structure of one of the heat exchangers shown in FIG. 17.
Figure 19:
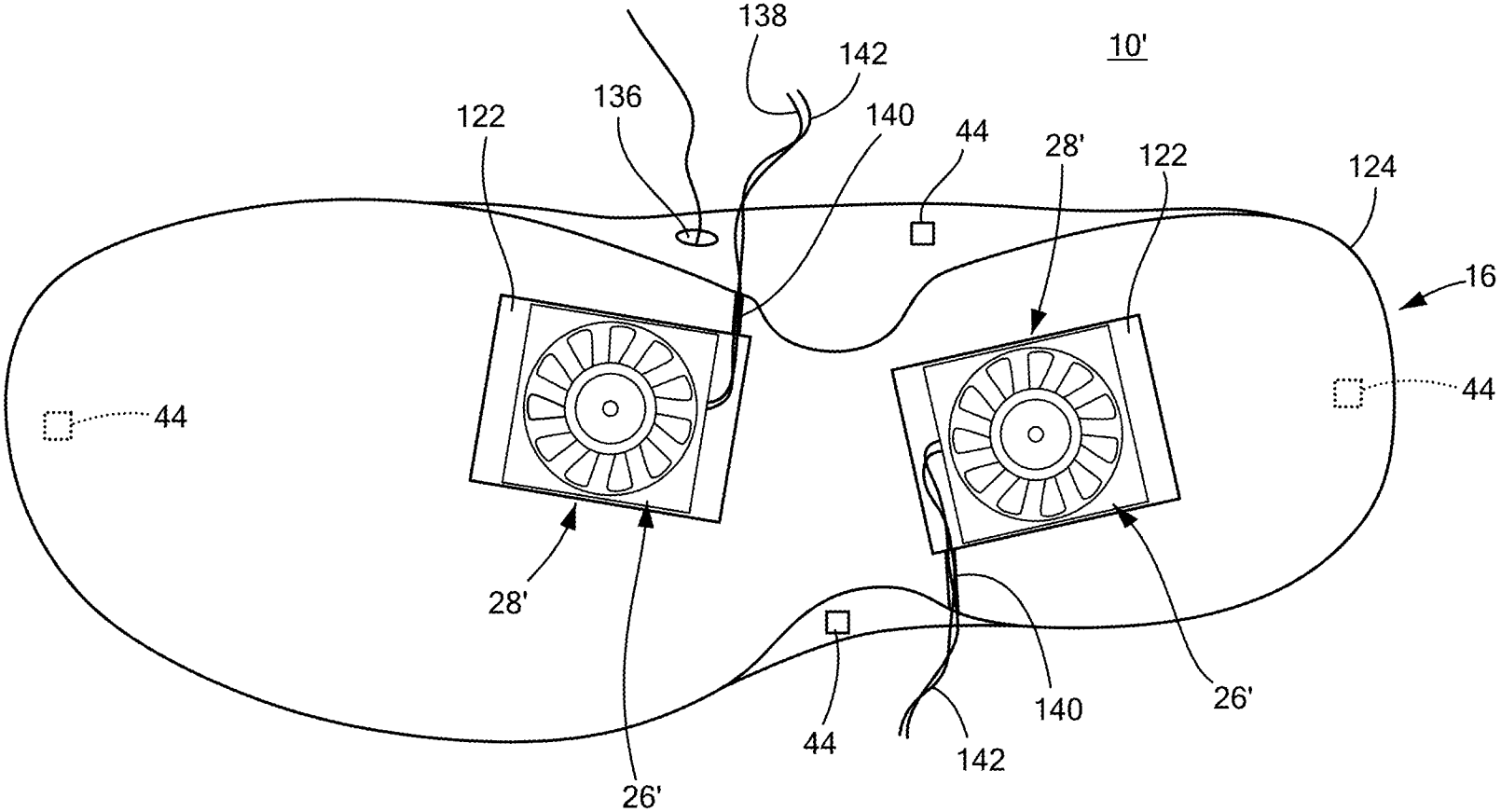
FIG. 19 is a three-dimensional bottom-view of a prototype system shown in FIGS. 17-18.

In another embodiment, instead of positioning heat exchanger 26 outside of article of footwear 16 as shown in one or more of FIGS. 1-10, system 10', FIGS. 17-19, and the method thereof for measuring and controlling foot temperature includes one or more heat exchangers 26', FIG. 17, each including TEC device 36' embedded into article of footwear 16, e.g., insole 18, or any desired location in article of footwear 16, and in close proximity to bottom 110, FIG. 18 of foot 112. TEC device 36' is similar to TEC device 36 discussed above with reference to FIG. 4. There are many options for the size and operating parameters of TEC device 36'. In one example, TEC device 36' may be a 40 mm×40 mm Peltier device with 127 couples and a six amp (A) maximum, e.g., model number TEC device 1-12706 available from Vktech, China. The size of TEC device 36' in this example is preferably large enough to affect a significant area of the plantar surface of a foot of a human subject while maintaining integrity in the sole of the article of footwear.

System 10' also includes a cooling device coupled to TEC device 36', e.g., fan 28' and/or heat sink 30'

System 10' also includes controller 44, similar as discussed above with reference to one or more of FIGS. 1-16, coupled to the heat exchanger 26' configured to control TEC device 36' to remove heat from bottom 110 of foot 112 to cool foot 112 or add heat to bottom 110 of foot 112 to heat foot 112, as discussed in detail below. System 10' also includes power supply 45, similar as discussed above with reference to one or more of FIGS. 1-16, coupled to TEC device 36' and controller 44.

System 10' may include one or more temperature sensors 48, FIGS. 18-19, disposed or embedded in or on article of footwear 16, e.g., insole 18, a side, a top, a front, or a back of the article of footwear 16, sole 20 of article of footwear 16, heat sink 30, and/or TEC device 36'. One or more temperature sensors 48 are in communication with controller 44 and are configured to measure a temperature of one or more of article of footwear 16, e.g., insole 18, a side, a top, a front, or a back of the article of footwear 16, sole 20 of article of footwear 16, heat sink 30, and/or TEC device 36'

One major challenge of using one or more heat exchangers 26', FIGS. 17-18, with TEC device 36' embedded in insole 18 is dissipating the heat that accumulates on hot side 106, FIG. 18, of TEC device 36' to environment 109. If this cannot be achieved, when TEC device 36' embedded into insole 18 begins operating, the heat will transfer back to cold side 106, reversing the cooling process. One key to addressing this problem includes finding an effective method of dissipating heat from hot side 108 of TEC device 36' to environment 109. The heat that needs to be dissipated includes the heat load from bottom 110 of foot 112, e.g., the plantar surface of foot 112 and the heat generated from each TEC device 36', which may be substantial. As referred to herein, waste heat is the sum of the heat dissipating from plantar surface 110 of foot 112 plus the heat generated from each TEC device 36' itself. In one example, heat pipes, heat sinks, and fans used alone or in combination may be used for dissipating waste heat from TEC device 36' to environment 109.

In one example, heat exchanger 26' provided temperatures on cold side 106 of TEC device 36' below about 20° C. and as low as about 10° C. for extended periods of time when no heat load is applied from foot 112. In this example, the input voltage to TEC device 36' may be adjusted using power supply 45 preferably coupled to controller 44 to determine the maximum input voltage and therefore the minimum temperature of cold side 106, FIG. 18, that could be achieved before hot side 108 and cold side 106 begin to heat up at which time fan 28' and heat sink 30' could no longer maintain adequate heat dissipation demands. Preferably, the voltage applied to TEC device 36' is optimized for its environment, including the load heat dissipated in foot 112 and the heat removal capabilities of heat sink 30' and fan 28'.

In one design, heat exchanger 26', including TEC device 36', heat sink 30' and fan 28' attached thereto is preferably embedded into cut-out area 122, FIG. 18, in sole 124 of article of footwear 16 as shown. In one prototype of system 10', FIG. 19, a plurality of heat exchangers 26' are preferably embedded into a plurality of cut-out areas 122 in sole 124 of article of footwear 16, e.g., the midfoot and heel locations, as shown. Fan 28' and heat sink 30', FIG. 18, of each heat exchanger 26', FIG. 19, are preferably secured tightly in place in cut-out areas 122, as shown. Each cut-out area 122 cut in sole 124 of article of footwear 126 is preferably designed to be in close proximity to bottom surface 110 of FIG. 18, foot 112, e.g., contacting bottom surface 110 of foot 112 as shown. Fan 28' circulates ambient air from beneath article of footwear 16 into fins 130 of heat sink 30'. Preferably, the air circulates around heat sink 30' and fan 28' and on the sides of fins 113 on heat sink 113 and exits via fan 28' within the circular region of the fan blades. Each cut-out area 122, FIGS. 18-19, in sole 18 is preferably large enough such that the air will circulate into fins 130, FIG. 18, on cold side 106 and exits into environment 109. In one example, thermal grease may be used between all thermal contact surfaces. In one design, small openings, e.g., opening 136, FIGS. 18-19, may be placed on the side of article of footwear 16 to provide an exit for wiring 138 coupled to TEC device 36' as shown. Additionally, one or more slits, e.g., slit 140, FIG. 19, shown in greater detail in FIG. 18, may be made in sole 124 in order to provide routing for each fan wire 142 without interference from walking.

In one example, insole 18, FIGS. 17-18 may be made of a closed cell cross-linked polyethylene foam, e.g., plastazote or similar type material, e.g., Cloud EVA (35-40 durometer), available from Sole Tech (Nahant, Mass.). Such a material provides a durable and thermos-moldable medium density EVA that provides excellent support and shock absorbing protection. It keeps its flexibility after molding and can be used against the skin. Insole 18 is preferably configured such that each TEC device 36' is secured tightly in place therein.

Similar as discussed above with reference to FIG. 15, insole 18 may include a phase change material, e.g., paraffin wax, microencapsulated paraffin wax, salt hydrates, polyethylene glycol, or similar type phase change material to cool the foot and reduce peak pressures.

Figure 20:
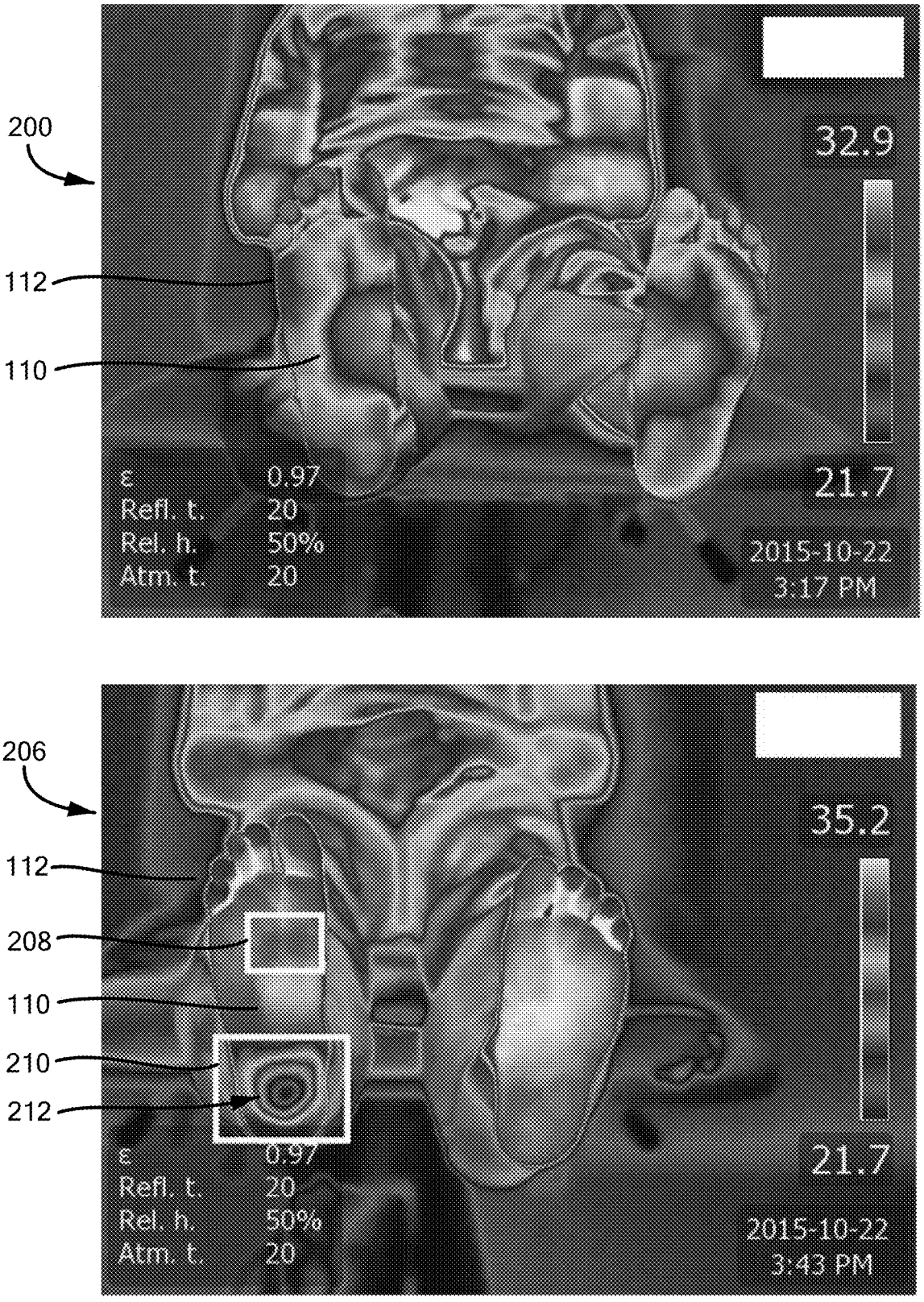
FIG. 20 shows exemplary thermal images obtained from testing the prototype system shown in FIGS. 17-19.

In one example, the effectiveness of system 10', FIGS. 17-19, to cool the temperature of a foot using the plurality of heat exchangers 26' was determined by measuring temperature of bottom 110 of foot 112, e.g., the plantar surface of foot 112, FIG. 18, after a test subjects walked in article of footwear 16 with the plurality of heat exchangers 26' therein, e.g., the prototype of system 10' shown in one of more of FIGS. 17-19 for 15 minutes. The temperature was measured using an infrared camera. A baseline temperature of insole 18 was quantified before the subjects began walking. The subjects were instructed to walk 15 minutes at self-selected speeds. After walking for 15 minutes, post-walking temperatures were obtained. It has been previously established by one or more of the inventors hereof that walking barefoot for 10 minutes results in an average temperature increase of about 5.3° C. in healthy subjects. In one example, two subjects walked with prototype heat exchangers 26' embedded into insole 18 of article of footwear 16 for 15 minutes. In this example, only the right shoe included heat exchangers 26' placed in the midfoot location and heel location as shown in detail in FIG. 20. In one test example, heat exchangers 26' located in cut-out area 122 located in the midfoot location failed during the test. FIG. 20 shows thermal images of the results of the test for this example. The images indicated at 200 show the temperature of plantar surface 110 of foot 112 before walking. The images indicated at 206 show the temperature of plantar surface 110 of foot 112 after walking. Squares 208 and 210 indicate the location of heat exchangers 26', FIGS. 18-19, at the midfoot location and heel location, respectively.

Figure 21:
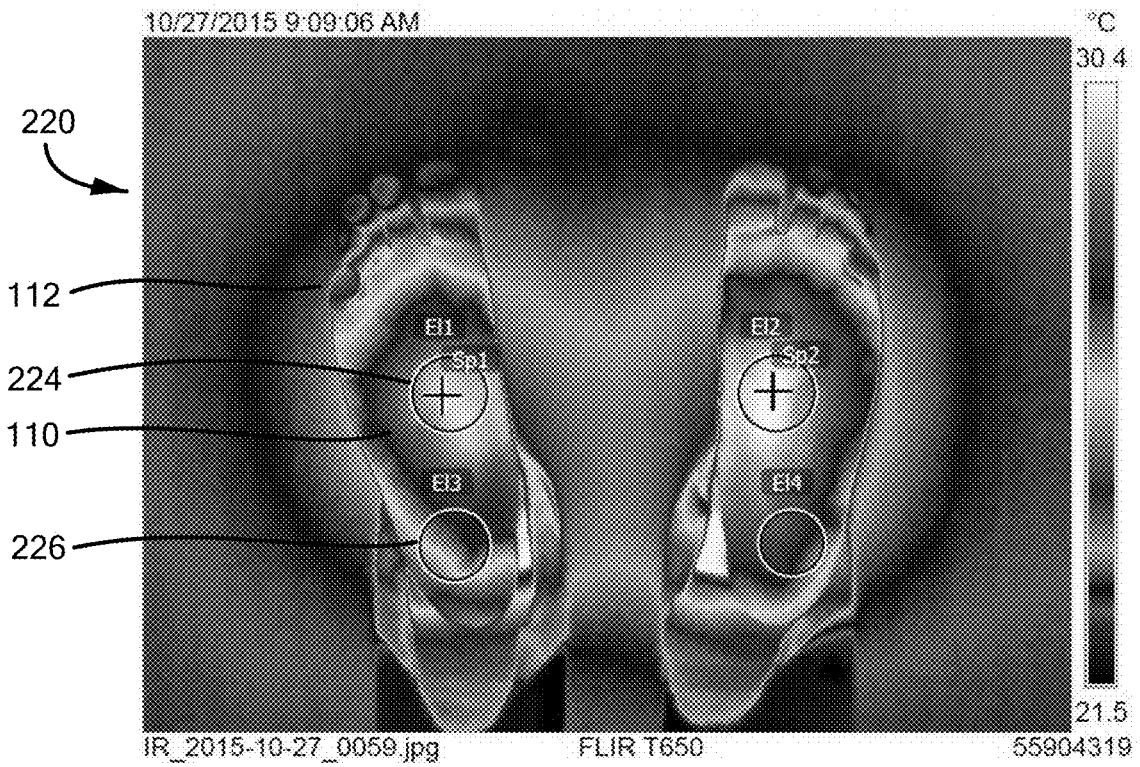
FIG. 21 shows exemplary thermal images obtained from testing the prototype system shown in FIGS. 17-19.
Figure 21:
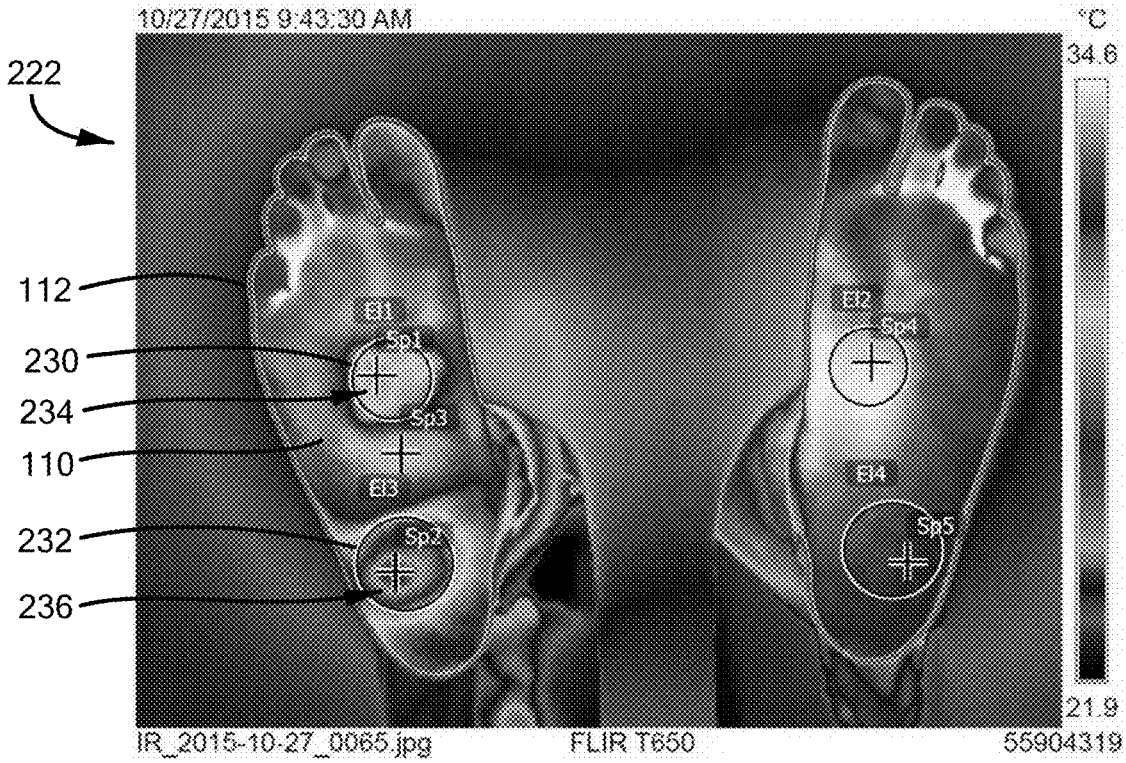

The defective heat exchanger 26' was repaired and another test example was conducted. The thermal images for this test example are shown in FIG. 21. The images indicated at 220 show the temperatures of surface 110 of foot 112, e.g., the plantar surface of foot 112, before walking. Circles 224 and 226 indicate the areas on plantar surface 110 for which mean temperatures were calculated for the midfoot and heel respectively and correspond with the locations of the heat exchangers 20'. The images indicated at 222 show the temperature of surface 110 of foot 112, e.g., the plantar surface of foot 113, after walking 15 minutes. Circles 230 and 232 indicate the areas on plantar surface 110 of foot 112 for which mean temperatures were calculated for the midfoot and heel respectively after walking 15 minutes, and correspond with the locations of the heat exchangers 20'.

The average temperatures of plantar surface 110 of foot 112 in the effective area where heat exchangers 20' were placed and as calculated over areas indicated by 224, 226, 230 and 232 are shown in Tables 1 and 2 below:

TABLE 1

| Test 1, Heel assembly only | | |
|---|---|---|
| | Right foot (prototype) | Left foot (control footwear) |
| Pre-walking temperature | 28.6 | 30.0 |
| Post-walking temperature | 25.8 | 33.6 |

TABLE 2

| Test 2, Midfoot and Heel assemblies | | |
|---|---|---|
| | Right foot (prototype) | Left foot (control footwear) |
| Pre-walking midfoot temperature | 29.6 | 29.9 |
| Pre-walking heel temperature | 26.6 | 27.6 |
| Post-walking midfoot temperature | 30.1 | 34.2 |
| Post-walking heel temperature | 26.5 | 32.3 |

In the thermal images shown in FIG. 20, where heat exchanger 20', FIGS. 17-19 located at the mid-foot location failed, there was no cooling in the region indicated by square 204, FIG. 20. Heat exchanger 26' located at the heel location function properly resulting in reducing temperatures down to an average of 22° C. from a baseline value of 28.6° C., e.g., as indicated at 212.

In the thermal images shown in FIG. 21, where heat exchanger 26', FIGS. 18-19 located at the mid-foot location and heat exchanger 26' located at the heel location both functioned properly, the mean temperature of surface 110 of foot 112 that did not experience any intervention with the prototype rose about 4.3° C. (14.4%) and 4.7° C. (17.0%), after 15 minutes of walking. However, the temperature differential in the corresponding sites of the plantar foot that was tested with the prototype of heat exchangers 26', FIG. 19, of system 10' in place was about 0.5° C. increase (1.7%) and about 0.17° C. decrease (−0.4%), respectively. The results shown in FIG. 21 demonstrate that system 10' and method thereof for measuring and controlling foot temperature of this invention provided cooling which prevented tissue from warming an approximate additional 12.7% at the midfoot location of heat exchanger 26', FIGS. 18-19, and an approximate additional 16.6% at the heel location.

Figure 22:
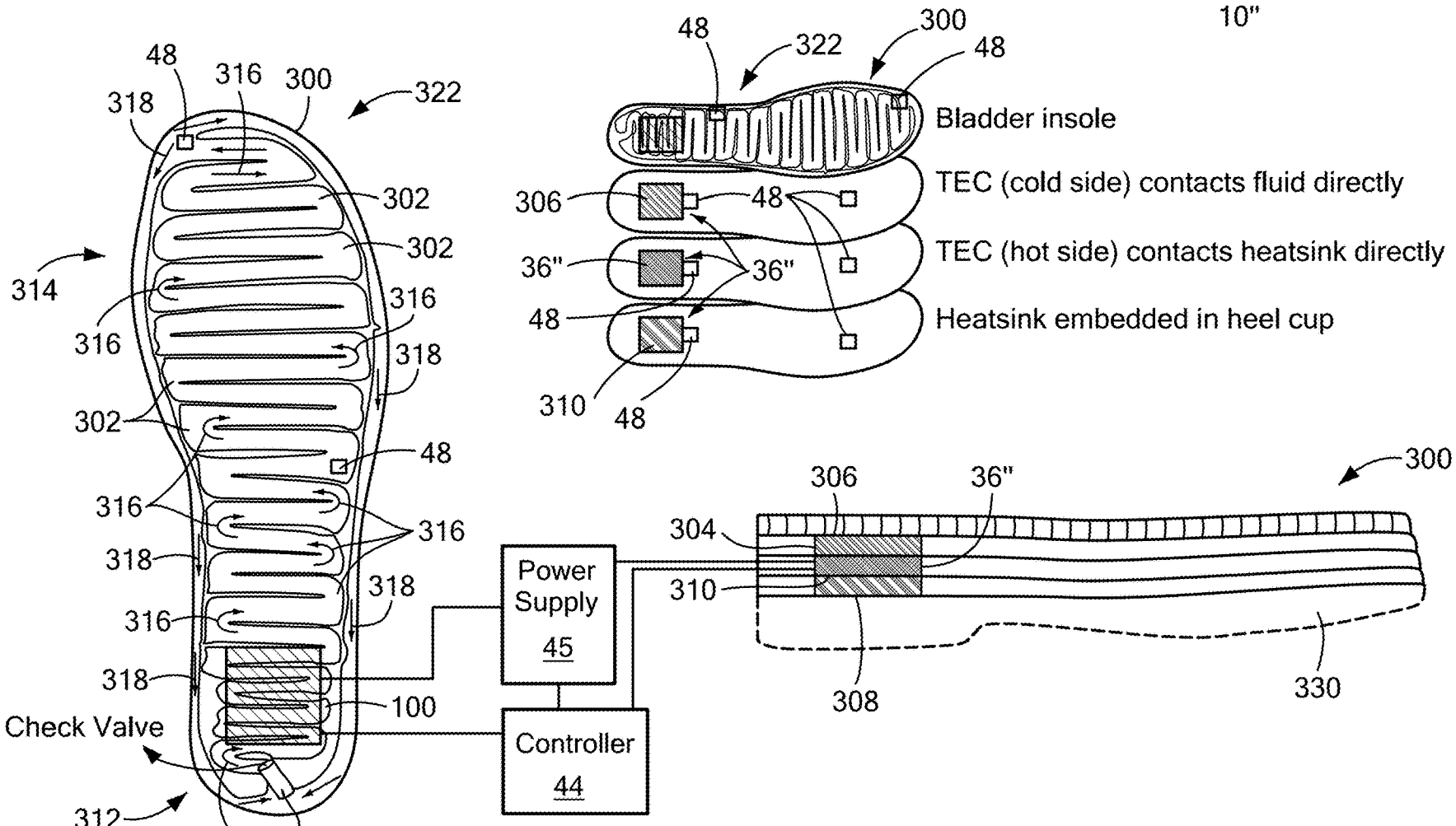
FIG. 22 is a three-dimensional top-view of another example of the system and method for controlling foot temperature of this invention.

In another embodiment, system 10", FIG. 22, and the method thereof for measuring and controlling temperature of this invention includes bladder insole 300 including a sealed plurality of fluidic pathways, exemplarily indicated at 302, having a cooling or heating fluid therein, e.g. water, antifreeze, or similar type fluid. Bladder insole 300 is disposed in an article of footwear, e.g., article of footwear 16 as discussed above with reference to one or more of FIGS. 1-19. Bladder insole 300 circulates the heating or cooling fluid through the sealed fluidic pathway in response to gate phases of a user while walking or running, as discussed below.

System 10" also includes TEC device 36" embedded in bladder insole 300 and configured to contact the heating or cooling fluid the plurality of sealed fluidic pathways 302. TEC device 36" is similar to TEC device 36 and TEC device 36' discussed above with reference to one or more of FIGS. 1-19. In this example, TEC device 36", FIG. 22, is preferably placed in an opening in bladder insole 300 which is about the same size as TEC device 36" and sealed in the opening as shown. Cold side 306 of TEC device 36" directly contacts the heating or cooling fluid in fluidic pathways 302 of bladder insole 300.

System 10" also includes power supply 45, having a similar design as discussed above with reference to on or more of FIGS. 1-10, coupled to TEC device 36". System 10" also preferably includes heat sink 308 coupled to hot side 310 of TEC device 36" as shown.

System 10" also includes a controller 44, having a similar design as discussed above with reference to one or more of FIGS. 1-10, coupled to the TEC device 36" and power supply 45. Controller 44 controls the current or voltage applied by power supply 45 to TEC device 36" such that side 306 of TEC device 36" in contact with the heating or cooling fluid in plurality of sealed fluidic pathways 302 removes heat from fluid to cool a foot of a user or side 306 of TEC device 36" in contact with the heating or cooling fluid in plurality of sealed fluidic pathways 302 adds heat to the fluid to heat the foot of a user, as discussed below.

In operation, fluid is pumped by bladder insole 300 using the progressive foot pressure that occurs during walking. The heating or cooling fluid in fluidic pathways 302 progresses from heel area 312 towards forefoot area 314 as shown by arrows 316 resulting from pressure force resulting of the heel contact, mid-stance and push-off phases of the gait of the user while walking. The fluid in fluidic pathways 302 returns to heel area 322 when the pressure on bladder insole 300 is removed during the swing phase of the gait, as shown by arrows 318. System 10" also preferably includes one-way check valve 320 located in heel area 312 of bladder insole 300 configured to prevent backward flow of the fluid in fluidic pathways 302. To ensure a uniform cooling or heating, bladder insole 300 preferably includes a maze-like structure as shown inside the bladder insole 300, indicated at 322. Bladder insole 33 is preferably comprised of a soft material, e.g., thermally conductive sponge material comprised of a thermally conductive closed cell silicone sponge rubber to ensure the cooling or heating fluid in fluidic pathways 302 is dispersed across a majority of the foot. The thermally conductive silicone sponge material preferably offers thermal conductivity, electrical isolation, excellent conformability to irregular surfaces, and a clean release from most materials. The thermally conductive silicone sponge material may have multiple thicknesses to fill various air gap heights and has a cellular structure which preferably provides a compliant gap filler. The thermally conductive silicone sponge material preferably provides for an unsupported thermal transfer in applications which may need a clean release, enhanced thermal performance by filling air gaps, and electrical isolation and vibration cushioning. The thermally conductive silicone sponge material also preferably provides for gasketing and cushioning applications requiring critical thermal transfer and sealing.

System 10" may include one or more temperature sensors 48 and disposed or embedded in bladder insole 300, heat sink 308, and/or TEC device 36". One or more temperature sensors 48 are in communication with controller 44 and are configured to measure a temperature of one or more of bladder insole 300, the fluid in plurality of sealed fluidic pathways 302, TEC device 36" and/or heat sink 308.

In operation, the heating or cooling fluid in the plurality of sealed fluidic pathways 302 enters heat exchanger 304 which is in contact with cold side 306 of TEC device 36'. The transfer of heat occurs and then the heating or cooling fluid in heat exchanger 306 is circulated throughout bladder insole 300 during gait discussed above.

Thus, system 10" eliminates the need for heat exchanger 26, 26' shown in one or more of FIGS. 1-22 that includes fan 28 and/or fluid block 32. One advantage of system 10" is the removal of a layer between the heating or cooling fluid and TEC device 36', as each layer acts as a barrier for heat transfer. Another advantage of system 10" is fluid filled bladder insole 300 conforms to the foot contour providing full contact. Increasing the contact area decreases may decrease stress on the foot. Additionally, by changing the polarity of the applied voltage (and therefore direction of electrical current) to TEC device 36", TEC device 36" may be used to heat the fluid in fluidic pathways 302 to heat an article of footwear 16 in cold climate conditions. Changing the polarity of the voltage applied to TEC device 36" results in a change of hot side and the cold side of TEC device 36" e.g. the cold side becomes the hot side and the hot side becomes the cold side to provide for cooling or heating, as discussed above.

Thus, system 10" may be used to cool the feet of a user in warm climate conditions or heat the foot in cold climate conditions to provide effective and efficient temperature regulation of the foot.

In one design, system 10" may be configured to be worn as a sock, thus enabling temperature regulation of the dorsal foot as well as lateral sides of the foot.

System 10" may also include secondary layer insole 330, preferably made of a synthetic material, e.g., plastozote, neoprene, or similar type material, located below bladder insole 300 as shown. Secondary layer insole 330 is preferably configured to absorb shock as the user walks. Although bladder insole 300 provides full contact and adequate pressure distribution, it may not function effectively as a shock absorber.

Figure 23:
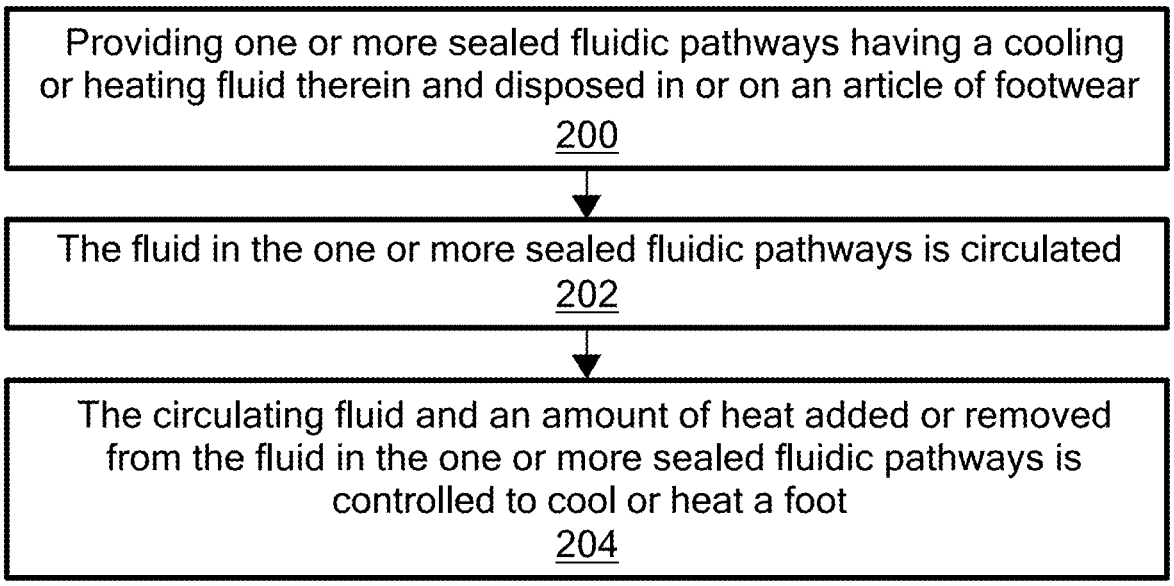
FIG. 23 is a block diagram showing the primary steps of one example of the method for measuring and controlling foot temperature.

One example of the method of measuring and controlling foot temperature includes providing one or more sealed fluidic pathways having a cooling or heating fluid therein and disposed in or on an article of footwear, step 200, FIG. 23. The fluid in the one or more sealed fluidic pathways is circulated, step 202. The circulating fluid and an amount of heat added or removed from the fluid in the one or more sealed fluidic pathways is controlled to cool or heat a foot, step 204.

Figure 24:
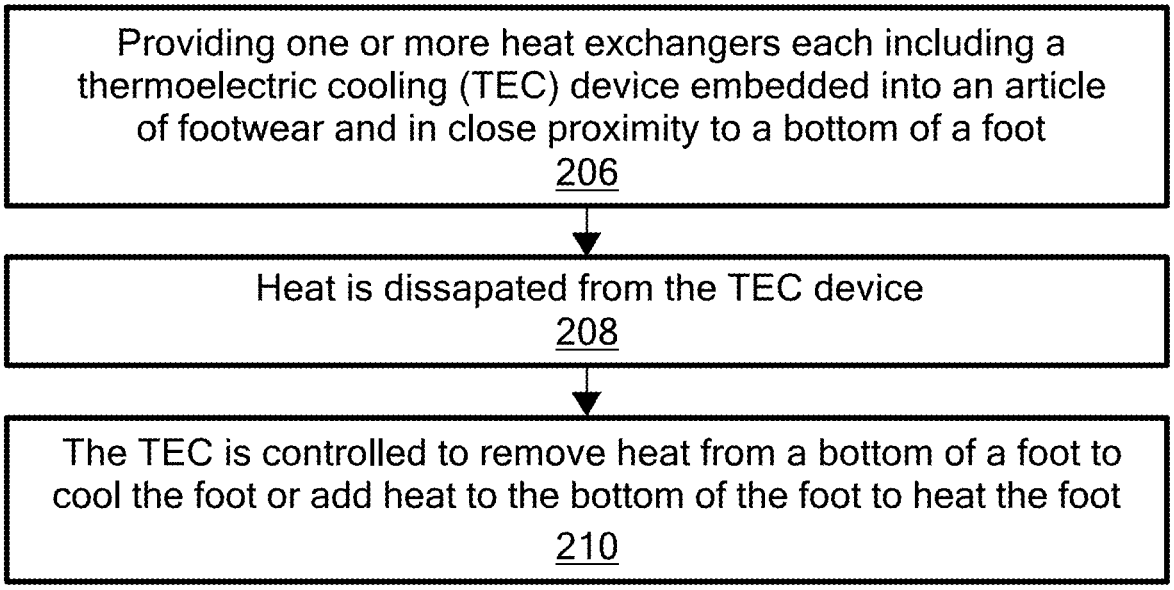
FIG. 24 is a block diagram showing the primary steps of another example of the method for measuring and controlling foot temperature.

Another example of the method of measuring and controlling foot temperature includes providing one or more heat exchangers each including a thermoelectric cooling (TEC) device embedded into an article of footwear and in close proximity to a bottom of a foot, step 206, FIG. 24. Heat is dissipated from the TEC device, step 208. The TEC device is controlled to remove heat from a bottom of a foot to cool the foot or add heat to the bottom of the foot to heat the foot, step 210.

The result is system 10, 10' and 10" and the method thereof shown in one or more of FIGS. 1-22 provides effective and efficient measuring and controlling of foot temperature to help reduce the problems associated with diabetic foot ulcers, ischemia related musculoskeletal injuries, pressure ulcers, or any other type of inflammatory foot disorders related to an increased temperature of the foot. System 10 also provides for heating the feet of a user in cold climate conditions.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

Other embodiments will occur to those skilled in the art and are within the following claims.

What is claimed is:

1. A system for measuring and controlling foot temperature, the system comprising:

a heating or cooling device including one or more sealed fluidic pathways having a cooling or heating fluid therein and disposed in or on an article of footwear or a sock;

a pumping device coupled to the heating or cooling device configured to circulate the fluid in the one or more sealed fluidic pathways;

a heat exchanger coupled to the heating or cooling device configured to remove or add heat from or to the fluid in the one or more sealed fluidic pathways, the heat exchanger including a fluid block in fluid communication with the one or more sealed fluidic pathways;

a controller coupled to the pumping device and the heat exchanger configured to control the pumping device to circulate the cooling or heating fluid in the one or more sealed fluidic pathways and also configured to control the heat exchanger to cool or heat a foot located inside the article of footwear or the sock;

a heat sink coupled to the fluid block, a fan coupled to the heat sink, and a power supply coupled to the controller; and the heat exchanger including a thermoelectric cooling (TEC) device positioned between the fluid block and the heat sink and coupled to the controller and the power supply.

2. The system of claim 1 in which the one or more sealed fluidic pathways are comprised of a thermally conductive material.

3. The system of claim 1 in which the one or more sealed fluidic pathways are configured in a loop.

4. The system of claim 1 in which the one or more sealed fluidic pathways are embedded or disposed in one or more of: an insole of the article of footwear, a side, a top, a front or a back of the article of footwear, a sole of the article of footwear, or the sock.

5. The system of claim 1 in which the pumping device is: integrated in a sole of the article of footwear, attached to a side, a top, a front, or a back of the article of footwear, configured to be attached to a user, attached to an article configured to be attached to the user, or attached to the sock.

6. The system of claim 1 in which the heat exchanger is embedded or disposed in one or more of: an insole of the article of footwear, a side, a top, a front, or a back of the article of footwear, a sole of the article of footwear, or the sock.

7. The system of claim 1 in which the controller is configured to control current or voltage applied to the TEC device such that the TEC device and the fluid block cools or heats the fluid in the one or more sealed fluidic pathways.

8. The system of claim 1 further including one or more temperature sensors in communication with the controller and disposed or embedded in or on one or more of: the sealed fluidic pathways, the fluid block, the heat sink, the TEC device, an insole of the article of footwear, a side, a top, a front, or a back of the article of footwear, a sole of the article of footwear, or the sock, wherein the one or more temperature sensors are configured to measure a temperature of one or more of: the fluid in the one or more sealed fluidic pathways, the fluid block, the heat sink, a hot side of the TEC device, a cold side of the TEC device, the insole of the article of footwear, a side, a top, a front, or a back of the article of footwear, a sole of the article of footwear, or the sock.

9. The system of claim 8 in which the controller is coupled to a proportional integral derivative (PID) control loop responsive to one or more measured input temperatures, the PID control loop configured to control a flow rate of the fluid output by the pumping device and the voltage and current applied to the TEC device to heat or cool the fluid in one or more sealed fluidic pathways.

10. The system of claim 1 further including a pressure sensor layer including a plurality of pressure sensors coupled to the controller, the pressure layer configured to measure pressure at a bottom of the foot.

11. The system of claim 1 further including a phase change layer including a phase change material, the phase change layer adapted to be placed under the foot and thermally coupled to the one or more sealed fluidic pathways, the phase change material configured to change phase in response to heat from the foot such that the phase change layer cools the foot.

* * * * *